US009046302B2

(12) United States Patent
Vink et al.

(10) Patent No.: US 9,046,302 B2
(45) Date of Patent: Jun. 2, 2015

(54) APPARATUS AND METHOD FOR COOLING AND LIQUEFYING A FLUID

(75) Inventors: Kornelis Jan Vink, Kuala Lumpur (MY); Leendert Johannes Arie Zoetemeijer, The Hague (NL)

(73) Assignee: Shell Oil Company, Houston, TX (US)

( * ) Notice: Subject to any disclaimer, the term of this patent is extended or adjusted under 35 U.S.C. 154(b) by 306 days.

(21) Appl. No.: 13/503,863

(22) PCT Filed: Oct. 25, 2010

(86) PCT No.: PCT/EP2010/066065

§ 371 (c)(1),
(2), (4) Date: Apr. 25, 2012

(87) PCT Pub. No.: WO2011/051226

PCT Pub. Date: May 5, 2011

(65) Prior Publication Data

US 2012/0240618 A1 Sep. 27, 2012

(30) Foreign Application Priority Data

Oct. 27, 2009 (EP) ..... 09174109

(51) Int. Cl.
*F25J 1/00* (2006.01)
*F25J 1/02* (2006.01)
(Continued)

(52) U.S. Cl.
CPC ..... *F25J 1/0262* (2013.01); *F25J 1/0022* (2013.01); *F25J 1/0052* (2013.01); *F25J 1/0055* (2013.01);
(Continued)

(58) Field of Classification Search
CPC ..... F25J 1/0022; F25J 1/0047; F25J 1/005; F25J 1/0052; F25J 1/0055; F25J 1/0249; F25J 1/02612; F25J 1/0262; F25J 1/0264; F25J 1/0254; F28F 9/026; F28F 9/0265; F28F 27/02
USPC ..... 62/606, 611, 612, 613, 614; 165/39
See application file for complete search history.

(56) References Cited

U.S. PATENT DOCUMENTS 3,212,278 A * 10/1965 Huddleston ..... 62/657
3,450,105 A * 6/1969 Osburn ..... 122/451 R
(Continued)

FOREIGN PATENT DOCUMENTS

DE 19518323 11/1996
DE 102007059541 6/2009
(Continued)

OTHER PUBLICATIONS

Bach, W., "Offshore Erdgasverflussigung Mit Stivckstoffkalte . . . ", Weisbaden, DE, No. 64, Jan. 1, 1990; pp. 31-37, XP000114322, ISSN: 0942-332X, p. 33, col. 3; p. 35, col. 3; figures 5, 6.

*Primary Examiner* — Frantz Jules
*Assistant Examiner* — Keith Raymond

(57) ABSTRACT

A fluid is cooled and liquefied in an apparatus with a heat exchanger. A plurality of flow passages has two or more primary groups of one or more primary flow passages. Each primary group carries a part of the fluid stream through the heat exchanger and indirectly cools the part of the fluid stream against a refrigerant in the shell side of the heat exchanger to provide a liquefied fluid stream. A primary inlet header connects the two or more primary groups of primary flow passages to a source of the fluid, and is arranged to split the fluid stream between the two or more primary groups of primary flow passages. Valves are provided for selectively blocking at least one of the two or more primary groups of primary flow passages whilst allowing the fluid stream to flow through the remaining unblocked primary groups of primary flow passages.

16 Claims, 5 Drawing Sheets

(51) Int. Cl.
*F25J 5/00* (2006.01)
*F28D 7/00* (2006.01)
*F28F 27/02* (2006.01)

(52) U.S. Cl.
CPC ..... *F25J 1/0214* (2013.01); *F25J 1/0216* (2013.01); *F25J 1/0241* (2013.01); *F25J 1/0245* (2013.01); *F25J 1/0292* (2013.01); *F25J 5/002* (2013.01); *F25J 2210/06* (2013.01); *F25J 2220/64* (2013.01); *F25J 2290/32* (2013.01); *F28D 7/0066* (2013.01); *F28F 27/02* (2013.01)

(56) References Cited

U.S. PATENT DOCUMENTS

| | | | | | |
|---|---|---|---|---|---|
| 4,050,506 | A * | 9/1977 | Small | ..... | 165/299 |
| 4,208,198 | A | 6/1980 | Small | ..... | 62/21 |
| 6,272,882 | B1 * | 8/2001 | Hodges et al. | ..... | 62/613 |
| 6,662,589 | B1 | 12/2003 | Roberts et al. | | |
| 7,219,512 | B1 | 5/2007 | Wilding et al. | | |
| 2007/0193303 | A1 | 8/2007 | Hawrysz et al. | | |
| 2007/0214831 | A1 | 9/2007 | Nanda | | |
| 2008/0134717 | A1 | 6/2008 | Dam et al. | | |
| 2010/0319396 | A1 * | 12/2010 | Dam et al. | ..... | 62/613 |

FOREIGN PATENT DOCUMENTS

| | | | | |
|---|---|---|---|---|
| EP | 1469266 | 10/2004 | | |
| JP | 11504104 | 4/1999 | | |
| JP | 2002340484 | 11/2002 | | |
| JP | 2006266532 | 10/2006 | | |
| JP | 2008503609 | 2/2008 | | |
| JP | 5118728 | 1/2013 | | |
| WO | WO2008068239 | 6/2008 | ..... | B01F 3/20 |
| WO | WO2011120096 | 10/2011 | ..... | F28D 7/10 |

* cited by examiner

APPARATUS AND METHOD FOR COOLING AND LIQUEFYING A FLUID

CROSS REFERENCE TO EARLIER APPLICATIONS

The present application is a national stage application of International application No. PCT/EP2010/066065, filed 25 Oct. 2010, which claims priority of EP09174109.0 filed in the European patent office on 27 Oct. 2009.

FIELD OF THE INVENTION

The present application relates to an apparatus for cooling and liquefying a fluid stream to provide a liquefied fluid stream, and to methods therefor.

BACKGROUND OF THE INVENTION

Natural gas is a useful fuel source, as well as being a source of various hydrocarbon compounds. It is often desirable to liquefy natural gas in an LNG plant at or near the source of a natural gas stream for a number of reasons. As an example, natural gas can be stored and transported over long distances more readily as a liquid than in gaseous form because it occupies a smaller volume and does not need to be stored at high pressure. Usually, natural gas, comprising predominantly methane, enters an LNG plant at elevated pressures and is pre-treated to produce a purified feed stream suitable for liquefaction at cryogenic temperatures. The purified gas is processed through at least one cooling stage using heat exchangers to progressively reduce its temperature until liquefaction is achieved. The liquid natural gas can then be further expanded to final atmospheric pressure suitable for storage and transportation.

The at least one cooling stage can comprise pre-cooling and main cooling stages, which sequentially reduce the temperature of the natural gas. The main cooling stage may be carried out in at least one main heat exchanger, to provide a liquefied, partially or fully liquefied, hydrocarbon stream, such as LNG.

U.S. Pat. No. 6,272,882 discloses a process for liquefying a gaseous, methane-rich feed stream to obtain LNG. The process utilises two cooling stages, a propane pre-cooling refrigerant cycle and a mixed refrigerant main cooling cycle. A main heat exchanger defining a shell side within its walls and at least one tube side extending through the shell side is used to liquefy natural gas in the main cooling stage. The natural gas is passed through one of the tube sides in hydrocarbon stream flow tubes where it is indirectly cooled and liquefied against the mixed main refrigerant in the shell side of the heat exchanger.

U.S. Pat. No. 6,272,882 employs advanced process control strategies, utilising mass flow rates of main refrigerant fractions and the hydrocarbon stream to be cooled, amongst others, as manipulated variables and the temperature differences within the main heat exchanger, amongst others, as controlled variables in order to optimise the production of LNG.

The advanced process control method of U.S. Pat. No. 6,272,882 can lead to changes in the mass flow rate of the hydrocarbon stream to be cooled as a manipulated variable.

In addition to changes in mass flow of the hydrocarbon stream as a result of advanced process control methods, a reduction in this mass flow may occur as a result of the partial shutdown of the liquefaction facility for repair and maintenance (so-called "turn down operation"), or during periods of lower demand for LNG.

A reduction in the mass flow of the hydrocarbon stream from the designed operational conditions can result in a decrease in the frictional pressure drop of the hydrocarbon stream across the main heat exchanger(s), increasing the potential for unstable behaviour in the cooling process.

SUMMARY OF THE INVENTION

In a first aspect, the present invention provides an apparatus for cooling and liquefying a fluid stream to provide a liquefied fluid stream, said apparatus comprising at least:

- a heat exchanger having a shell side within its walls and a plurality of flow passages extending through the shell side of the heat exchanger, said plurality of flow passages comprising two or more primary groups of one or more primary flow passages, each said primary group for carrying a part of the fluid stream through the heat exchanger and to indirectly cool said part against a refrigerant in the shell side of the heat exchanger to provide a liquefied fluid stream;
- a primary inlet header connecting the two or more primary groups of primary flow passages to a source of the fluid, and arranged to split the fluid stream between the two or more primary groups of primary flow passages;
- means for selectively blocking at least one of the two or more primary groups of primary flow passages in response to a flow rate of the fluid stream, whilst allowing the fluid stream to flow through the remaining unblocked primary groups of primary flow passages.

In a further aspect, the present invention provides a method of cooling and liquefying a fluid stream to provide a liquefied fluid stream, comprising at least the steps of:

- passing a fluid stream and a refrigerant to an apparatus as defined in the first aspect, to provide a liquefied fluid stream.

In a preferred aspect, said passing of the fluid stream to the apparatus comprises allowing the fluid stream into the primary inlet header and selectively blocking at least one of the two or more primary groups of primary flow passages in response to the flow rate of the fluid stream, whilst allowing the fluid stream to flow through the remaining unblocked primary groups of primary flow passages.

In still another aspect, the present invention provides a method of cooling and liquefying a fluid stream to provide a liquefied fluid stream, comprising at least the steps of:

- passing a fluid stream at a flow rate, and a refrigerant, to an apparatus comprising at least a heat exchanger having a shell side within its walls and a plurality of flow passages extending through the shell side of the heat exchanger, said plurality of flow passages comprising two or more primary groups of one or more primary flow passages, each said primary group for carrying a part of the fluid stream through the heat exchanger and to indirectly cool said part against a refrigerant in the shell side of the heat exchanger to provide a liquefied fluid stream, and a primary inlet header connecting the two or more primary groups of primary flow passages to a source of the fluid, and arranged to split the fluid stream between the two or more primary groups of primary flow passages;
- allowing the fluid stream into the primary inlet header; and
- selectively blocking at least one of the two or more primary groups of primary flow passages in response to a flow rate of the fluid stream, whilst allowing the fluid stream to flow through the remaining unblocked primary groups of primary flow passages to provide a liquefied fluid stream.

BRIEF DESCRIPTION OF THE DRAWINGS

Embodiments of the present invention will now be described by way of example only and with reference to the accompanying non-limited drawings in which.

For the purpose of this description, a single reference number will be assigned to a line as well as a stream carried in that line. Similar reference numbers indicate similar lines or components. As used herein, the terms "flow" and "mass flow" refer to "mass flow rate".

DETAILED DESCRIPTION OF THE INVENTION

Figure 1:
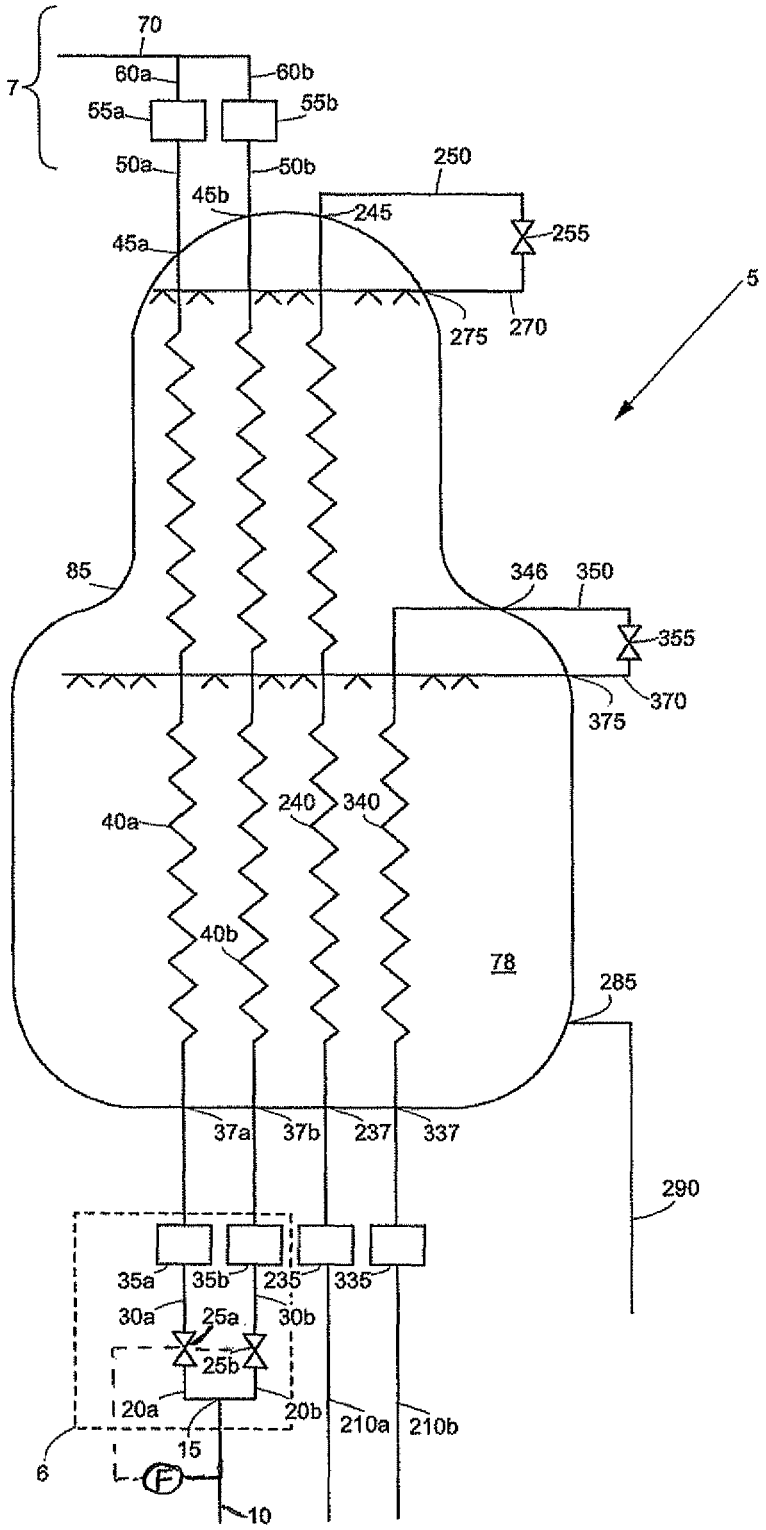
FIG. 1 is a diagrammatic scheme of an apparatus for liquefying a hydrocarbon stream according to one embodiment.

The present disclosure describes an apparatus for cooling and liquefying a fluid stream to provide a liquefied fluid stream, and methods therefor.

In the context of the present disclosure, the term "liquefied" generally means partially or fully liquefied, unless otherwise specified.

The fluid stream may be provided in the form of a liquefied product stream, e.g. to be sold or transported to another location, or it may be used internally in a method wherein the apparatus is employed, for instance as a refrigerant to provide cooling duty to one or more heat exchangers. The fluid stream may be provided in the form of a hydrocarbon stream. Such hydrocarbon stream, in the context of the present disclosure, may be derived from natural gas, or from a synthetic source. The liquefied hydrocarbon stream may be used as a product stream, for instance in the form of liquefied natural gas (LNG), or it may be used internally in a method wherein the apparatus is employed, for instance as a refrigerant stream to provide cooling duty.

The present disclosure proposes an apparatus and method which may mitigate against unstable behaviour during a reduction in the mass flow of the fluid stream, by providing a heat exchanger having a plurality of primary groups of primary flow passages through which the fluid stream flows during its liquefaction, whereby at least one of the primary groups of primary flow passages can be selectively blocked whilst directing the fluid to flow to the remainder of the primary flow passages. In this way, any reduction in the frictional pressure drop across all the primary flow passages as a result of lower mass flow can be mitigated against by directing the fluid stream through a reduced number of primary flow passages. A method is proposed for cooling and liquefying a fluid stream comprising at least the step of passing the fluid stream and a refrigerant through such an apparatus.

The present invention has been conceived in an effort to better accommodate mass flow variations of the fluid stream that is to be liquefied.

The methods and apparatuses described herein advantageously operate with a fluid stream of which the mass flow varies over time, providing enhanced turn down characteristics arising from the thermal design of the apparatus.

The selective blocking of at least one of the primary groups of primary flow passages can be carried out in response to a reduction in the flow rate of the fluid stream. In this way, a method of accommodating turn down of a liquefaction facility can be provided if the liquefaction facility comprises the apparatus according to the first aspect above. Clearly, the selective blocking of selectively blocked groups of flow passages may be ended in response to an increase of the flow rate leading to restoration or partial restoration of the flow rate, to restore the flowing of fluid through the previously blocked group of flow passages.

The cooled and liquefied fluid stream is preferably exported from the apparatus and/or method. The majority of the cooled and liquefied fluid stream is removed from and not fed back into the apparatus and/or method. Typically, exporting involves making it available for transporting away from the apparatus/method to another location. Optionally, it may be stored in a storage tank before and/or during and/or after said transporting.

U.S. Pat. No. 4,208,198 discloses a method wherein variations in a heat exchange load in terms of the volume of hot vapour are compensated for by a stepwise complete closing of a uniformly-spaced-apart fraction of the cold vapour passageways in a heat exchanger. It is remarked that this method does not solve the stability problem described above that is associated with reduction in the frictional pressure drop across the heat exchanger experienced by the fluid flow.

In the remainder of this description, the fluid will often be assumed to be a hydrocarbon fluid, the fluid stream a hydrocarbon fluid stream, and the apparatus will often be assumed to be an apparatus for cooling and liquefying a hydrocarbon stream to provide a liquefied hydrocarbon stream. Consequently, primary flow passages or groups thereof may sometimes hereinbelow be referred to as "hydrocarbon flow passages".

The apparatus for cooling and liquefying the hydrocarbon stream comprises a heat exchanger having a plurality of hydrocarbon flow passages traversing through the shell side of the heat exchanger. It will be apparent to the person skilled in the art that the method and apparatus disclosed herein can be applied to any heat exchanger comprising a shell and a plurality of flow passages in which condensation of a fluid takes place.

The hydrocarbon in the hydrocarbon flow passages can be indirectly heat exchanged against a refrigerant in the shell side of the heat exchanger. Such an apparatus can be designed for an optimal production of a liquefied hydrocarbon stream, such as LNG or a condensed Gas To Liquid (GTL) product. During production at the designed output, the hydrocarbon stream can be split between all the hydrocarbon flow passages. There will be a particular frictional pressure drop across the hydrocarbon flow passages resulting from the mass flow of the hydrocarbon stream at the designed output.

The hydrocarbon flow tubes are normally arranged circumferentially in the main heat exchanger at an angle, normally spiralling around the middle of the exchanger, such that as the hydrocarbon stream flows from the bottom to the top of the main heat exchanger it is at least partly condensed and changes phase from a vapour to a liquid. The condensed liquid hydrocarbon is denser than the vapour phase, so that, in the absence of sufficient driving force for the mixture to move upwards, it will fall back down the hydrocarbon flow tubes. Thus, the liquefaction method is designed to operate with hydrocarbon stream having a flow velocity and frictional pressure drop which is sufficient to move the liquefied hydrocarbon upwards and out of the main heat exchanger.

However, the mass flow of the hydrocarbon stream may at times decrease, for instance during a turn down event or specifically as a result of advanced process control optimisation. This may result in a decrease in frictional pressure drop across the hydrocarbon flow passages.

If the mass flow of the hydrocarbon stream is reduced it may reach a level at which the condensed hydrocarbon will run back down the hydrocarbon flow tubes, agglomerating to provide a liquid plug which can temporarily block the passage of the vaporous hydrocarbon stream. The pressure of the vaporous hydrocarbon stream will therefore increase beneath the liquid hydrocarbon plug until it is dislodged. Further plugs will continue to form if the mass flow of the hydrocarbon stream is too low, leading to repeated liquid plug formation and release within the hydrocarbon flow tubes producing unstable flow behaviour within the main heat exchanger. This behaviour results in rapid thermal oscillations in the main exchanger, and may (over prolonged times) contribute to the mechanical failure of the exchanger, for instance as a result of tube leaks.

This can be avoided by maintaining the frictional pressure drop in the fluid being liquefied at or close to the design levels. In order to maintain the hydrocarbon stream frictional pressure drop across the hydrocarbon flow passages at or close to design levels, it is proposed that hydrocarbon stream is selectively provided to some, but not all, of the hydrocarbon stream flow passages. By spreading the reduced mass flow of the hydrocarbon stream across fewer hydrocarbon flow passages, any reduction in frictional pressure drop can be mitigated. This allows the method and apparatus to operate effectively at mass flows of the hydrocarbon stream lower than the design conditions.

In this way, it is possible to design a heat exchanger which will have a reduced pressure drop during designed operation at 100% mass flow of the hydrocarbon stream, while still being capable of stable operation at a reduced mass flow of the hydrocarbon stream. This can lead to a reduction in the diameter and complexity of the heat exchanger, lowering the manufacturing cost.

An alternative approach would be to design the main heat exchanger to have a stable operation at the minimum mass flow rate of the hydrocarbon stream by accommodating the pressure drop.

For example, for a main heat exchanger with single phase flow, the relationship between mass flow and pressure drop within the hydrocarbon flow tubes is approximately quadratic. Thus, for instance, a cooling process designed to exhibit stable behaviour at a 50% reduction in the mass flow of the hydrocarbon stream would require the main heat exchanger to be designed with a four times higher pressure drop than necessary for a 100% mass flow of the hydrocarbon stream. However, manufacturing a main heat exchanger to accommodate such increased pressure drops in the hydrocarbon flow tubes leads to significant increases in CAPEX and reduction in the production capacity of the liquefied product, such as LNG. The presently disclosed heat exchanger is expected be more cost effective and more practical.

In addition, the heat exchanger disclosed herein designed for a smaller pressure drop is thermodynamically more efficient, even at reduced mass flow, compared to an exchanger designed to accommodate a higher pressure drop. This is because with a lower pressure drop, the liquefaction pressure is higher, allowing a higher liquefaction temperature and so increased production capacity. In accordance with standard exergy theory, providing an equivalent heat duty at a higher temperature provides less compressor power.

The apparatus disclosed herein can therefore be designed to accommodate reductions in the mass flow of the hydrocarbon stream in excess of 50%, such as reductions of 60% or more, 70% or more or 80% or more.

FIG. 1 is a diagrammatic scheme of an apparatus 1 comprising a heat exchanger 5 which can be used to cool and liquefy a fluid in the form of a hydrocarbon stream 10. The hydrocarbon stream 10 may be derived from natural gas obtained from natural gas or petroleum reservoirs, but may alternatively be obtained from another source, also including a synthetic source such as a Fischer-Tropsch process. The hydrocarbon stream 10 may have been pre-treated, and this is discussed in greater detail below.

The heat exchanger 5 may be a coil wound heat exchanger or a shell and tube heat exchanger. The heat exchanger 5 has a wall 85, defining and encompassing an internal volume comprising a shell side 78. The internal volume further comprises a plurality of flow passages, such as flow tubes. These flow passages are grouped in groups each comprising one or more of the flow passages. For simplicity, FIG. 1 shows four groups of such flow passages: two primary groups of flow passages 40*a*,40*b* for transporting the fluid to be liquefied through the heat exchanger 5; a secondary group 240 of auto-cooling flow passages for transporting the refrigerant to be liquefied by auto-cooling; and a ternary group 340 of auxiliary flow passages for cooling an auxiliary stream such as for instance another refrigerant composition. It will be understood by the skilled person that each group may contain many tens or hundreds of flow passages. These flow passages are preferably arranged to transport their contents from an inlet 37*a*, 37*b*, 237, 337 at or near the bottom of the heat exchanger 5 to an outlet 45*a*, 45*b*, 245, 346 at a point gravitationally higher within the heat exchanger 5.

In the further description hereinbelow, the secondary group of auto-cooling flow passages may be referred to as "refrigerant first flow passages", while the ternary group of auxiliary flow passages may be referred to as "refrigerant second flow passages" assuming that these groups of flow passages are in the examples used for refrigerant streams.

The groups of flow passages 40, 240, 340 comprise two or more hydrocarbon flow passages 40*a*, 40*b*. Each hydrocarbon flow passage carries a part 40*a*, 40*b* of the hydrocarbon stream 10. The part hydrocarbon streams 40*a*, 40*b* are indirectly cooled against a refrigerant in the shell side 78 of the heat exchanger 5, which usually travels downward through the shell side 78 under influence of gravity.

A primary inlet header 6 connects the two or more primary groups 40*a*, 40*b* of primary flow passages (here: the hydrocarbon flow passages 40*a*,40*b*) to a source of the hydrocarbon fluid to be cooled and liquefied. The primary inlet header 6 is arranged to split the hydrocarbon fluid stream 10 between the two or more primary groups of primary flow passages 40*a*, 40*b*.

Means are provided for selectively blocking at least one of the two or more primary groups of primary flow passages whilst allowing the fluid stream to flow through the remaining unblocked primary groups of primary flow passages. In the embodiment of FIG. 1, these means form part of the primary inlet header but this does not have to be a requirement of the invention.

The means for selectively blocking the at least one of the two or more primary groups of primary flow passages is operated in response to a flow rate of the fluid stream. The apparatus may comprise a means to control the selective blocking in response to a signal representing the flow rate of the fluid stream 10. Such a signal may be generated employing a means to determine, preferably measure, the flow rate of the fluid stream in line 10. In the embodiment of FIG. 1, this is depicted as a flow sensor F connected to line 10. However, the flow rate of the fluid stream in line 10 may be directly determined using a flow sensor in another line instead, such as line 70, and/or indirectly calculated from an alternative parameter directly or indirectly relating to flow.

Where the refrigerant is a main refrigerant in a main cooling refrigerant circuit, the heat exchanger 5 is a main heat exchanger. The main refrigerant may be a mixed main refrigerant. Examples of suitable mixed main refrigerants are discussed in more detail below. The main refrigerant can be provided to the shell side 78 of the main heat exchanger at at least one main refrigerant inlet 275*a*, 275*b*, as an at least partially, preferably fully, liquefied main refrigerant.

The flow passages of all the groups are laid out intertwined together such that the cooling duty provided by the refrigerant is evenly distributed amongst them. Liquid refrigerant droplets can form a film on each of the flow passages in the groups 40, 240, 340. Heat is exchanged between the refrigerant and the contents of the flow passages. The groups of flow passages 40, 240, 340 each comprise a heat exchange surface arranged to be in heat exchanging interaction with the refrigerant in the shell side of the main heat exchanger 5. Viewed vertically within the main heat exchanger 5, the flow passages are distributed such that the refrigerant films can flow along the flow tubes that make up the flow passages, from a gravitationally higher point to a gravitationally lower point. The respective contents of the flow passages flow along the heat exchange surfaces in a direction against gravity. Thus, for example the fluid stream 10 flows through the unblocked primary groups against gravity, i.e. from a gravitationally lower point to a gravitationally higher point. Refrigerant droplets can fall away and transfer between neighbouring flow tubes 40, 240, 340 in order to maintain an even thermal distribution within the shell 78.

As the main refrigerant cools the contents of the flow passages in the groups 40, 240, 340, the main refrigerant is warmed and may be vaporised. The warmed main refrigerant is withdrawn through at least one main refrigerant outlet 285 at or near the bottom of the main heat exchanger 5, as warmed main refrigerant stream 290.

In the embodiment shown in FIG. 1, a mixed refrigerant having first and second fractions of a main refrigerant is used to cool the hydrocarbon part streams 40*a*, 40*b*. The first fraction 210*a* of the main refrigerant stream is passed to a first fraction main refrigerant passage inlet 237 of the main heat exchanger 5. A first fraction 210*a* of a main refrigerant stream is auto-cooled against main refrigerant in the shell side 78 of the exchanger by passing it through at least one main refrigerant first flow passage 240 to provide at least one cooled first fraction main refrigerant stream 250 at a first fraction main refrigerant passage outlet 245. A single cooled first fraction main refrigerant stream 250 is shown in FIG. 1.

The at least one cooled first fraction main refrigerant stream 250 can be passed to at least one expansion device, here shown in the form of a first fraction main refrigerant expansion device 255, where the at least one stream is expanded to provide at least one expanded first fraction main refrigerant stream 270. The at least one expanded first fraction main refrigerant stream 270 can then be passed to the shell side 78 of the main heat exchanger 5 as at least one cooling main refrigerant stream. The at least one cooling main refrigerant stream is passed to at least one expanded first fraction main refrigerant inlet 275 to provide main refrigerant to cool the fluids in the plurality of flow passages 40, 240, 340.

Similarly, a second fraction 210*b* of a main refrigerant stream is passed to a second fraction main refrigerant passage inlet 337 of the main heat exchanger 5. The second fraction 210*b* of the main refrigerant stream is auto-cooled against main refrigerant in the shell side 78 of the exchanger by passing it through at least one ternary group of one or more auxiliary flow passages, here represented in the form of main refrigerant second flow passage 340, to provide at least one cooled second fraction main refrigerant stream 350 at second fraction main refrigerant passage outlet 345. A single cooled second fraction main refrigerant stream 350 is shown in FIG. 1.

The at least one cooled second fraction main refrigerant stream 350 can be passed to at least one second fraction main refrigerant expansion device 355 where the at least one stream is expanded to provide at least one expanded second fraction main refrigerant stream 370. The at least one expanded second fraction main refrigerant stream 370 can then be passed to the shell side 78 of the main heat exchanger 5 as at least one cooling main refrigerant stream. The at least one cooling main refrigerant stream is passed to at least one expanded second fraction main refrigerant inlet 375 to provide main refrigerant to cool the fluids in the groups of flow passages 40, 240, 340.

During normal operation of the main heat exchanger 5 at design capacity, each of the two or more hydrocarbon flow passages may carry a part 40*a*, 40*b* of the hydrocarbon stream to cool and liquefy it against the main refrigerant. Sometimes the mass flow of the hydrocarbon stream 10 reduces, for instance as a result of advanced process control processes, as a result of partial shutdown or as result of a reduced supply or demand. If the mass flow of the hydrocarbon stream 10 into the primary inlet header 6 reduces over time, preferably if it reduces to below a set threshold value, the method and apparatus described herein can selectively block at least one of the hydrocarbon flow passages 40*a*, 40*b*. Such a reduction in mass flow of the hydrocarbon stream 10 is also called "turn down". The selective blocking allows the reduced mass flow of the hydrocarbon stream to be distributed amongst fewer hydrocarbon flow passages 40*a*, 40*b* in the main heat exchanger 5, such that the pressure drop in the flow passages remains substantially unchanged, or does not change sufficiently to produce unstable cooling behaviour.

In the embodiment shown in FIG. 1, two primary groups 40*a*, 40*b* of primary flow passages are shown, which groups are referred to as hydrocarbon flow passages 40*a*, 40*b*. In reality, each of these groups typically represents a plurality of flow passages within the main heat exchanger 5. In response to a reduction in the mass flow of the hydrocarbon stream 10, one or other of the two hydrocarbon flow passages 40*a*, 40*b* may be selectively blocked, while allowing mass flow through the remaining unblocked hydrocarbon flow passages.

Also the secondary and ternary groups of flow passages 240 & 340 each comprise one or more auto-cooling or auxiliary flow passages, connected to auto-cooling and auxiliary inlet headers 235,335. The auto-cooling and auxiliary inlet headers in the present example are refrigerant inlet headers. Because the flow passages in the groups 40, 240, 340 are uniformly distributed through the main heat exchanger 5, the selective blocking of at least one of the hydrocarbon flow passages 40*a*, 40*b* will not lead to an uneven thermal distribution and thermal gradients within the exchanger.

The embodiment shown in FIG. 1 is advantageous for providing a turn down of more than 50% in mass flow from the designed operating capacity, because half (i.e. one) of the hydrocarbon flow passages 40*a*, 40*b* may be selectively blocked in response to a 50% or more reduction in the mass flow rate of the hydrocarbon stream 10, in order to maintain a substantially constant pressure drop within the main heat exchanger 5.

It will be apparent that more than two primary groups of primary flow passages may provide further turn down options. For instance with three primary groups (hydrocarbon flow passages) of which at least two are selectively blockable, it would be possible to accommodate approximately 33% and 66% turn down operations, by selectively blocking one of the three and two of the three primary groups of primary flow passages, respectively. In a further example, if four hydrocarbon flow passages (primary groups) are provided, of which at least three are selectively blockable, it would be possible to accommodate approximately 25%, 50% and 75% turn down operations, by selectively blocking one, two or three of the hydrocarbon flow passages, respectively.

The selective blocking of the two or more hydrocarbon flow passages 40*a*, 40*b* may be achieved by the use a primary part stream inlet control valve, here provided in the form of at least one hydrocarbon part stream inlet control valve 25. The at least one hydrocarbon part stream inlet control valve 25 operates to control the mass flow of the part hydrocarbon stream to the at least one of the hydrocarbon flow passages. At least one hydrocarbon part stream inlet control valve 25 is provided for each hydrocarbon flow passage (primary group) to be selectively blocked.

Preferably, the hydrocarbon part stream inlet control valve 25 is controlled by snap-action control (i.e. a two-position on/off control mode) whereby the controller either opens or closes the valve 25. Preferably, no throttling takes place in the valve 25.

Such inlet control valve 25 may be controlled by a controller that uses the signal representing the flow rate from sensor F. If the flow rate drops below a set first threshold value, it closes the inlet control valve 25. If the flow rate increases above a set second threshold value, it opens the valve 25. The first and second threshold values may be different from each other to avoid oscillation. Alternatively, it could be a manual operation whereby the valve 25 is manually controlled.

FIG. 1 shows one embodiment, wherein the primary inlet header 6 comprises two or more primary part stream inlet headers 35*a*, 35*b*, which may in the present example also be referred to as "hydrocarbon part stream inlet headers". Each is uniquely connected to one of the primary groups of primary flow passages 40*a*,40*b* in the form of hydrocarbon flow passages. A primary header stream splitting device 15 is arranged to separate the fluid stream 10 into two or more fluid part streams 20*a*,20*b* each in a fluid part stream conduit. In the present example, the fluid part streams may also be referred to as "hydrocarbon part streams". The means for selectively blocking is here embodied in the form of a primary part stream inlet control valve 25*a*,25*b* in each of the fluid part stream conduits 20*a*,20*b*. In the present example, the primary part stream inlet control valves may also be referred to as "hydrocarbon part stream inlet control valves", and the fluid part stream conduits 20*a*,20*b* as "hydrocarbon part stream conduits".

In the embodiment of FIG. 1, the hydrocarbon stream 10 is passed to the primary header stream splitter 15 the hydrocarbon stream between the two or more hydrocarbon flow passages 40*a*, 40*b*. The means for splitting 15 may comprise a hydrocarbon stream splitting device. The hydrocarbon stream splitting device 15 the can provide two or more hydrocarbon part streams 20*a*, 20*b*.

Each of the two or more hydrocarbon part streams 20*a*, 20*b* may be passed to a hydrocarbon part stream inlet control valve 25*a*, 25*b*. The hydrocarbon part stream inlet control valve 25*a*, 25*b* provides a controlled hydrocarbon part stream 30*a*, 30*b*.

Two or more hydrocarbon part stream inlet headers 35*a*, 35*b* are provided to receive the controlled hydrocarbon part streams 30*a*, 30*b*. Each hydrocarbon part stream inlet header 35*a*, 35*b* is connected to a hydrocarbon flow passage 40*a*,40*b*, or group of flow passages, to be selectively blocked together. Thus, by closing a hydrocarbon stream inlet control valve 25*a*, 25*b*, the part hydrocarbon stream 20*a*, 20*b* is prevented from reaching the respective hydrocarbon part stream inlet header 35*a*, 35*b*, and therefore the respective hydrocarbon flow passage 40*a*, 40*b* or groups of flow passages.

For instance, closing the hydrocarbon stream inlet control valve 25*b* will prevent part hydrocarbon stream 20*b* from reaching the hydrocarbon flow passage 40*b*. If the hydrocarbon stream inlet control valve 25*a* is kept open, mass flow through the hydrocarbon flow passage 40*a* can be maintained via hydrocarbon part stream inlet header 35*a*.

It will be apparent that more than one hydrocarbon flow passage 40*a*, 40*b* can be connected to a particular hydrocarbon part stream inlet header 35*a*, 35*b*. In the embodiment shown in FIG. 1, equal proportions (i.e. one) of the hydrocarbon stream flow passages 40*a*, 40*b* can be connected to a given hydrocarbon part stream inlet header 35*a*, 35*b*. In such an embodiment, closing hydrocarbon stream inlet control valve 25*b* would selectively block half of the hydrocarbon flow passages 40*a*, 40*b* i.e. flow passages 40*b*. This line-up could provide stable cooling in an approximately 50% turn down of the mass flow of the hydrocarbon stream 10.

In a further embodiment (not shown in FIG. 1), unequal proportions of the two or more hydrocarbon flow passages 40*a*, 40*b* could be connected to different hydrocarbon part stream inlet headers 35*a*, 35*b*. For example, double the number of hydrocarbon flow passages could be connected to a second hydrocarbon part stream inlet header compared to a first hydrocarbon part stream inlet header. Consequently, closing the hydrocarbon stream inlet control valve for the first hydrocarbon part stream inlet header would provide selective blocking of 33% of the hydrocarbon flow passages, allowing a 33% reduction in the mass flow of the hydrocarbon stream 10 while maintaining a relatively constant pressure drop in the remaining unblocked flow passages for a 33% turn-down. Similarly, closing the hydrocarbon stream inlet control valve for the second hydrocarbon part stream inlet header would provide selective blocking of 67% of the hydrocarbon flow passages, accommodating a 67% turn down of the mass flow of hydrocarbon stream 10. It will be apparent that such embodiments may require the means for splitting 15 the hydrocarbon stream between the two or more hydrocarbon flow passages 40*a*, 40*b* to provide the desired proportion of the mass flow of the hydrocarbon stream 10 to the two or more hydrocarbon part stream inlet headers 35*a*, 35*b*.

The two or more hydrocarbon flow passages 40*a*, 40*b* exit the main heat exchanger at two or more hydrocarbon flow passage outlets 45*a*, 45*b*. Each outlet 45*a*, 45*b* produces a liquefied hydrocarbon stream 50*a*, 50*b*. The two or more hydrocarbon flow passages 40*a*, 40*b* can be connected to at least one hydrocarbon stream outlet header 55*a*, 55*b* to combine the liquefied hydrocarbon streams 50*a*, 50*b*.

The two or more hydrocarbon flow passages 40*a*, 40*b* may be connected to a primary outlet header 7 to combine the liquefied hydrocarbon fluid streams flowing out of the two or more primary groups of primary flow passages. In the present example, the primary outlet header comprises two or more primary part stream outlet headers 55*a*,55*b*. In the present example they take the form one hydrocarbon stream outlet header 55*a*, 55*b* for each hydrocarbon flow passage 40*a*, 40*b*. Each hydrocarbon part stream outlet header 55*a*, 55*b* can provide a liquefied hydrocarbon part stream 60*a*, 60*b*.

The liquefied hydrocarbon part streams 60*a*, 60*b* can be combined in a liquefied hydrocarbon stream combining device 65 to provide a combined liquefied hydrocarbon stream 70.

In an alternative embodiment (not shown in FIG. 1), a single hydrocarbon stream outlet header combines all the hydrocarbon flow passages, to provide the combined liquefied hydrocarbon stream.

No flow sensor is shown in the remaining figures; notwithstanding, it may be present anyhow in order to assist in controlling the selective blocking as explained above.

Figure 2:
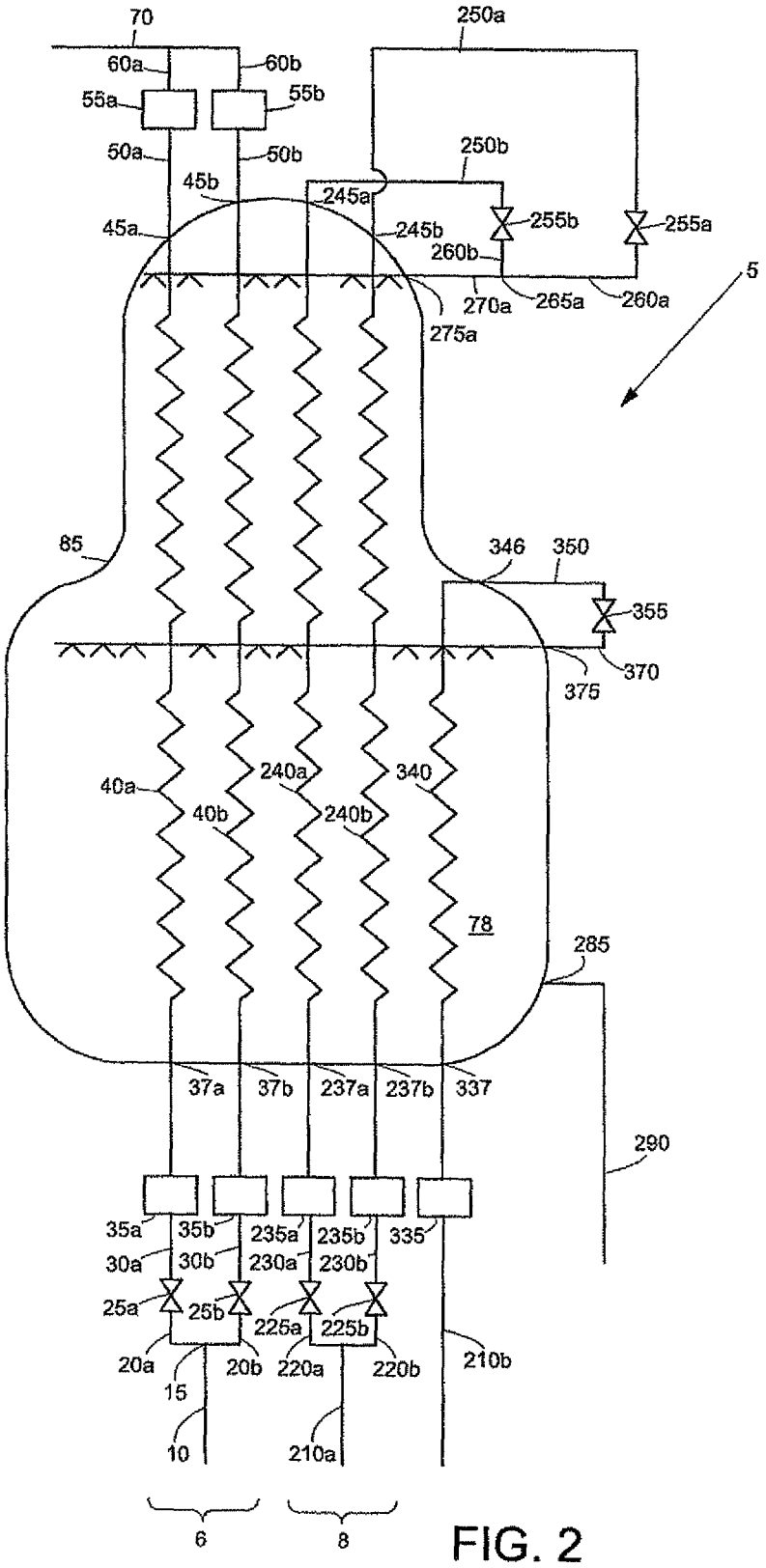
FIG. 2 is a diagrammatic scheme of an apparatus for liquefying a hydrocarbon stream according to a further embodiment.

FIG. 2 schematically illustrates a group of embodiments wherein the plurality of flow passages further comprises two or more secondary groups 240*a*, 240*b* of one or more auto-cooling flow passages. These will for the present example be referred to as refrigerant first flow passages 240*a*, 240*b*. A secondary inlet header 8 connects the two or more secondary groups of auto-cooling flow passages 240*a*, 240*b* to a source 210*a* of the refrigerant. The secondary inlet header 8 is further arranged to split the refrigerant stream between the two or more secondary groups of auto-cooling flow passages. Similar to the primary inlet header 6, the secondary inlet header 6 may also comprise means for selectively blocking at least one of the two or more secondary groups of auto-cooling flow passages whilst allowing the refrigerant stream to flow through the remaining unblocked secondary groups of auto-cooling flow passages. These means may be referred to as "secondary means".

Thus the apparatus 1 of FIG. 2 is a diagrammatic scheme of an apparatus 1 comprising a heat exchanger 5 which can be used to cool and liquefy a hydrocarbon stream 10. The heat exchanger 5 is preferably a main heat exchanger in a similar manner to the embodiment of FIG. 1, such that the refrigerant to indirectly cool the part hydrocarbon streams 40*a*, 40*b* is a main refrigerant.

It will be apparent that during turn down operation in which the mass flow of the hydrocarbon stream 10 is reduced, the cooling duty required by the hydrocarbon stream will also be reduced. In order to prevent over cooling of the reduced-flow hydrocarbon stream 10, it is preferred that the mass flow of main refrigerant to the main heat exchanger 5 is also reduced. The reduction of the mass flow of the main refrigerant in step with that of the hydrocarbon stream can keep the demand for and supply of cooling duty matched, even during turn-down operation.

The embodiment of FIG. 2 advantageously utilises a mixed main refrigerant which can be supplied to the main heat exchanger 5 as first and second fraction main refrigerant streams 210*a*, 210*b*. The operation of the hydrocarbon stream 10 and second fraction main refrigerant stream 210*b* is similar to that discussed for the embodiment of FIG. 1. However, the main heat exchanger 5 of FIG. 2 provides two or more refrigerant first flow passages 240*a*, 240*b*, together with said secondary means for selectively blocking 225*a*, 225*b* at least one of the two of more refrigerant first flow passages 240*a*, 240*b*, such that the mass flow of the first fraction main refrigerant stream 210*a* through the main heat exchanger 5 can be reduced when the mass flow of the hydrocarbon stream 10 is reduced, without incurring unstable cooling behaviour.

The first fraction main refrigerant stream 210*a* can be passed to a means for splitting 215*a* the first fraction main refrigerant stream 210*a* between the two or more main refrigerant first flow passages 240*a*, 240*b*. The means for splitting 215*a* may comprise a first fraction main refrigerant stream splitting device. The first fraction main refrigerant stream splitting device 215*a* can provide two or more first fraction main refrigerant part streams 220*a*, 220*b*.

Each of the two or more first fraction main refrigerant part streams 220*a*, 220*b*, may be passed to a first fraction main refrigerant part stream inlet control valve 225*a*, 225*b*. The first fraction main refrigerant part stream inlet control valve 225*a*, 225*b* provides a controlled first fraction main refrigerant part stream 230*a*, 230*b*.

Two or more first fraction main refrigerant part stream inlet headers 235*a*, 235*b* are provided to receive the controlled first fraction main refrigerant part streams 230*a*, 230*b*. Each first fraction main refrigerant part stream inlet header 235*a*, 235*b* is connected to one main refrigerant first flow passage 240*a*, 240*b* (secondary group of flow passages) via respective first fraction main refrigerant passage inlets 237*a*,237*b*. The main refrigerant first flow passage 240*a*, 240*b* can be selectively blocked. Thus, by closing a first fraction main refrigerant part stream inlet control valve 225*a*, 225*b*, the respective first fraction main refrigerant part stream 220*a*, 220*b* is prevented from reaching the respective first fraction main refrigerant part stream inlet header 235*a*, 235*b* and therefore the respective main refrigerant first flow passage 240*a*, 240*b*.

The first fraction 210*a* of a main refrigerant stream can be auto-cooled against main refrigerant in the shell side 78 of the exchanger in the main refrigerant first flow passages 240*a*, 240*b* to provide two or more cooled first fraction main refrigerant streams 250*a*, 250*b*. The two or more main refrigerant first flow passages 240*a*, 240*b* exit the wall 85 of the main heat exchanger 5 at two or more first fraction main refrigerant passage outlets 245*a*, 245*b*.

Furthermore, the embodiment of FIG. 2 further comprises at least one expansion device 255*a*, 255*b* downstream of the secondary groups of auto-cooling flow passages. The expansion device is arranged upstream of a refrigerant inlet device 275*a*, into the shell of the heat exchanger 5 and connected to the refrigerant inlet device. The expansion devices may also be referred to as "first fraction main refrigerant expansion devices" for the purpose of the present example.

The two or more cooled first fraction main refrigerant streams 250*a* can be passed to two or more first fraction main refrigerant expansion devices 255*a*, 255*b* where they can be expanded to provide two or more expanded first fraction main refrigerant streams 260*a*, 260*b*. The two or more expanded first fraction main refrigerant streams 260*a*, 260*b* can then be combined in a first fraction main refrigerant combining device 265*a* to provide a cooling main refrigerant stream 270*a*. The cooling main refrigerant stream 270*a* can be passed to the shell side 78 of the main heat exchanger 5 via at least one expanded first fraction main refrigerant inlet 275*a* to provide main refrigerant to cool the fluids in the groups of flow passages 40*a*, 40*b*, 240*a*, 240*b*, 340.

In order for the first fraction of the main refrigerant stream 210*a* to be turned down in step with the hydrocarbon stream 10, it is preferred that the proportion of the two or more main refrigerant first flow passages 240*a*, 240*b* which can be selectively blocked is the same as the proportion of the two or more hydrocarbon flow passages 40*a*, 40*b* which can be selectively blocked.

The embodiment of FIG. 2 does not provide a means for selectively blocking the refrigerant second flow passages 340 in the main heat exchanger 5. This is because the second fraction main refrigerant stream 210*b* may be provided as a liquid stream, such that no phase transition and more particularly condensation of the second fraction would occur during cooling in the refrigerant second flow passage 340. Consequently, such a liquid second fraction main refrigerant stream 210*b* would not exhibit unstable behaviour at reduced mass flow during the cooling process.

However, it will be apparent to the skilled person that should the second fraction main refrigerant stream 210*b* not be provided as a fully liquid stream, or if it is desired to avoid a change in the pressure drop in the main refrigerant second flow passage 340, then a main heat exchanger comprising two or more main refrigerant second flow passages could be provided. Furthermore, means for selectively blocking at least one of the second flow passages, whilst allowing a part of the second fraction of the main refrigerant to flow through the remaining unblocked refrigerant second flow passages, would allow a reduction in the mass flow of the second fraction main refrigerant stream 210*b*. This could be achieved using a configuration of second fraction main refrigerant valves and second fraction main refrigerant headers in a similar manner to those of the first fraction main refrigerant.

Figure 3:
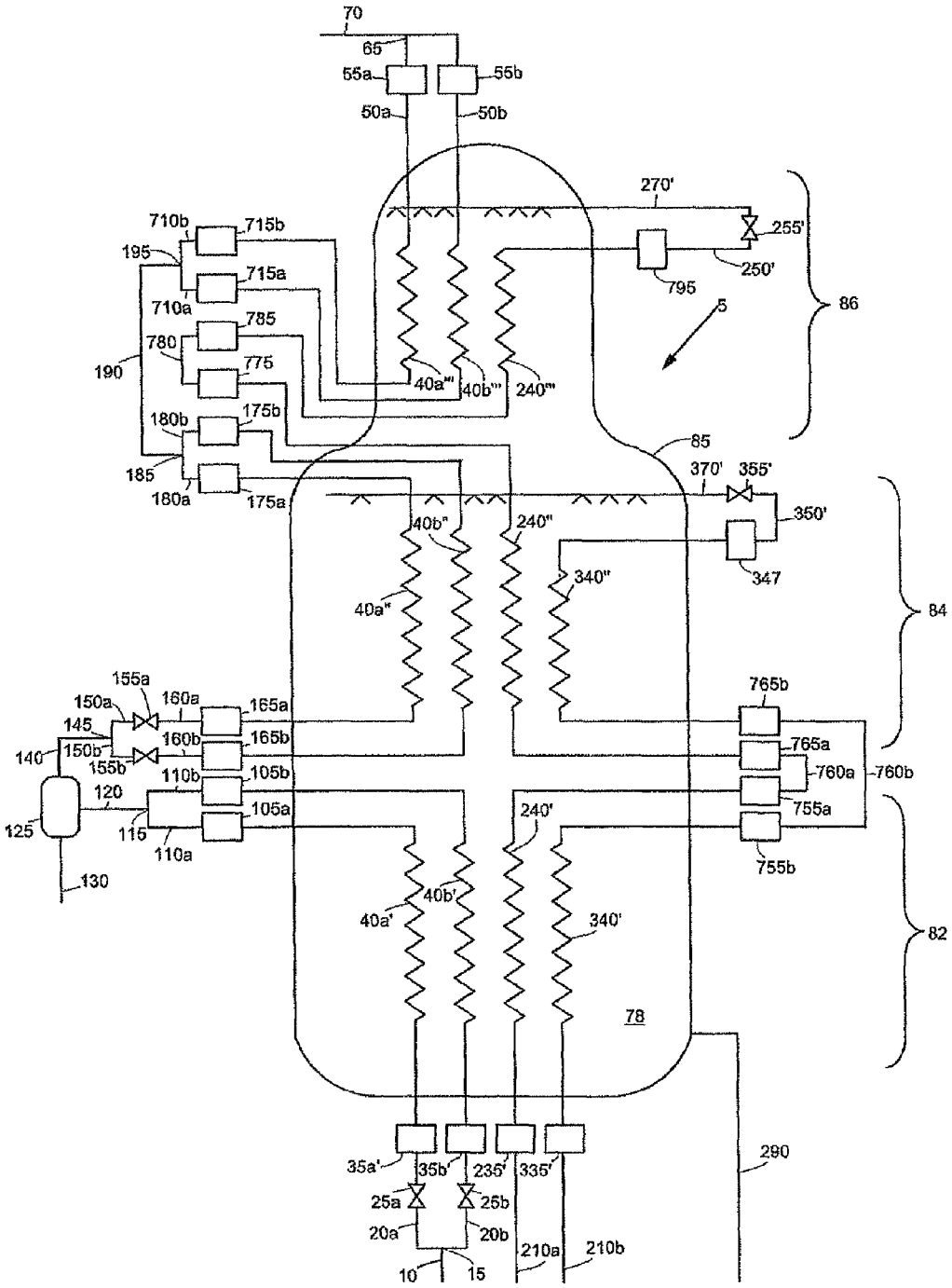
FIG. 3 is a diagrammatic scheme of an apparatus for liquefying a hydrocarbon stream according to another embodiment.

FIG. 3 shows a third embodiment of the method and apparatus disclosed herein in which the heat exchanger 5 is a main heat exchanger in which the groups of flow passages 40*a*, 40*a*', 40*a*", 40*b*, 40*b*', 40*b*", 240, 240', 240", 340, 340' are split into multiple flow passage bundles. A flow passage bundle comprises at least one flow passage passing through the wall 85 of the heat exchanger 5 between a pair of inlet and outlet headers.

In a similar manner to the embodiments of FIGS. 1 and 2, the hydrocarbon stream 10 is split into hydrocarbon first and second part streams 20*a*, 20*b*, which are passed to hydrocarbon first and second part stream inlet control valves 25*a*, 25*b*. The hydrocarbon first and second part stream inlet control valves 25*a*, 25*b* provide controlled hydrocarbon first and second part streams 30*a*, 30*b* to hydrocarbon first and second part stream lower inlet headers 35*a*', 35*b*'.

In contrast to the embodiments of FIGS. 1 and 2, the main heat exchanger 5 of FIG. 3 splits the flow passages into a plurality of bundles at different levels within the exchanger. FIG. 3 shows lower bundles 82 comprising the hydrocarbon first and second lower flow passages 40*a*', 40*b*' and main refrigerant first and second lower flow passages 240', 340'. Intermediate bundles 84 comprise the hydrocarbon first and second intermediate flow passages 40*a*", 40*b*" and main refrigerant first and second intermediate flow passages 240", 340". Upper bundles 86 comprise the hydrocarbon first and second upper flow passages 40*a*'", 40*b*'" and the main refrigerant first upper flow passage 240'".

The hydrocarbon first and second part stream lower inlet headers 35*a*', 35*b*' are connected to hydrocarbon first and second lower flow passages 40*a*', 40*b*' respectively. These hydrocarbon stream flow passages can be selectively blocked using the respective hydrocarbon part stream inlet control valve 25*a*, 25*b*.

The hydrocarbon first and second lower flow passages 40*a*', 40*b*' are connected to hydrocarbon first and second part stream lower outlet headers 105*a*, 105*b* respectively. The hydrocarbon first and second part stream lower outlet headers 105*a*, 105*b* produce first liquefied hydrocarbon first and second part streams 110*a*, 110*b*, which can be passed to a first liquefied hydrocarbon stream combining device 115. The first liquefied hydrocarbon stream combining device 115 provides a combined first liquefied hydrocarbon stream 120. The combined first liquefied hydrocarbon stream 120 is preferably a partly liquefied stream, such as a two-phase stream comprising liquid and vapour phases.

The combined first liquefied hydrocarbon stream 120 can be passed to a first liquefied hydrocarbon stream separation device 125, such as a gas/liquid separator, which can provide a bottoms first liquefied hydrocarbon stream 130 as a liquid stream and an overhead first cooled hydrocarbon stream 140 as a vapour stream. The bottoms first liquefied hydrocarbon stream 130 can be passed to at least one fractionation device for Natural Gas Liquids extraction, or can be used as reflux in a separation device.

The overhead first cooled hydrocarbon stream 140 can be passed to a first cooled hydrocarbon stream combiner device 145, which combines the stream into overhead first cooled hydrocarbon first and second part streams 150*a*, 150*b*. The overhead first cooled hydrocarbon first and second part streams 150*a*, 150*b* can be passed to first cooled hydrocarbon first and second part stream inlet control valves 155*a*, 155*b* respectively to provide controlled first cooled hydrocarbon first and second part streams 160*a*, 160*b*. The controlled first cooled hydrocarbon first and second part streams 160*a*, 160*b* can be passed to hydrocarbon first and second part stream intermediate inlet headers 165*a*, 165*b*. The hydrocarbon first and second part stream intermediate inlet headers 165*a*, 165*b* are connected to hydrocarbon first and second intermediate flow passages 40*a*", 40*b*". The first cooled hydrocarbon first and second part stream inlet control valves 155*a*, 155*b* can thus be used to selectively block access to the hydrocarbon first and second intermediate flow passages 40*a*", 40*b*".

The hydrocarbon first and second intermediate flow passages 40*a*", 40*b*" are connected to hydrocarbon first and second part stream intermediate outlet headers 175*a*, 175*b* respectively. The hydrocarbon first and second part stream intermediate outlet headers 175*a*, 175*b* produce second cooled hydrocarbon first and second part streams 180*a*, 180*b*, which can be passed to a second cooled hydrocarbon stream combining device 185. The second cooled hydrocarbon stream combining device 185 provides a combined second cooled hydrocarbon stream 190. The combined second cooled hydrocarbon stream 190 may be a partly liquefied stream, and is preferably a fully liquefied stream.

The combined second cooled hydrocarbon stream 190 can be passed to an optional second cooled hydrocarbon stream separation device 195, which could splits the stream into split second cooled hydrocarbon first and second part streams 710*a*, 710*b*. The split second cooled hydrocarbon first and second part streams 710*a*, 710*b* can be passed to hydrocarbon first and second part stream upper inlet headers 715*a*, 715*b*. The hydrocarbon first and second part stream upper inlet headers 715*a*, 715*b* are connected to hydrocarbon first and second upper flow passages 40*a*'", 40*b*'" which pass through the wall 85 into the main heat exchanger 5.

The hydrocarbon first and second upper flow passages 40*a*'", 40*b*'" exit the heat exchanger 5 as liquefied hydrocarbon streams 50*a*, 50*b* as discussed in relation to the embodiment of FIG. 1. In the embodiment in which the combined second liquefied hydrocarbon stream 190 is a fully liquefied stream, means for selectively blocking at least one of the first and second upper flow passages 40*a*'", 40*b*'" would not be required because the streams will be substantially free of vapour components and therefore less likely to exhibit unstable behaviour in the cooling process during a reduction in the mass flow of the hydrocarbon stream 10. Consequently, it will be apparent to the skilled person that in an alternative embodiment (not shown in FIG. 3) the second liquefied hydrocarbon stream separation device 195 may not be required such that all the hydrocarbon upper flow passages may be supplied from a single hydrocarbon upper inlet header connected to the combined second hydrocarbon stream 190.

In an alternative embodiment (not shown in FIG. 3) in which the combined second liquefied hydrocarbon stream 190 is a two-phase stream comprising liquid and vapour phases, means for selectively blocking at least one of the first and second upper flow passages 40*a*'''', 40*b*'''' may be provided in a similar manner to the lower and intermediate stages 82, 84.

In the embodiment shown in FIG. 3, a mixed refrigerant having first and second fractions of a main refrigerant is used to cool the hydrocarbon part streams in hydrocarbon flow passages 40*a*', 40*b*', 40*a*'', 40*b*'', 40*a*''', 40*b*'''.

The first fraction 210*a* of a main refrigerant stream is auto-cooled by indirect heat exchange against main refrigerant in the shell side 78 of the exchanger by passing it through at least one main refrigerant lower flow passage 240', at least one main refrigerant intermediate flow passage 240'' and at least one main refrigerant upper first flow passage 240'''.

The first fraction 210*a* of the main refrigerant stream can be passed to at least one first fraction main refrigerant part stream inlet header 235'. Each first fraction main refrigerant part stream inlet header 235' is connected to at least one main refrigerant lower first flow passage 240' or group of such flow passages. The other end of the at least one main refrigerant lower first flow passage 240' is connected to main refrigerant first fraction lower outlet header 755*a*.

The main refrigerant first fraction lower outlet header 755*a* is connected to at least one main refrigerant first fraction lower stream 760*a*. The at least one main refrigerant first fraction lower stream 760*a* is passed to a main refrigerant first fraction intermediate inlet header 765*a*.

The main refrigerant first fraction intermediate inlet header 765*a* is connected to at least one main refrigerant intermediate first flow passage 240'' or group of such flow passages. The other end of the at least one main refrigerant intermediate first flow passage 240'' is connected to main refrigerant first fraction intermediate outlet header 775.

The main refrigerant first fraction intermediate outlet header 775 is connected to at least one main refrigerant first fraction intermediate stream 780. The at least one main refrigerant first fraction intermediate stream 780 is passed to a main refrigerant first fraction upper inlet header 785.

The main refrigerant first fraction upper inlet header 785 is connected to at least one main refrigerant upper first flow passage 240''' or group of such flow passages. The other end of the at least one main refrigerant upper first flow passage 240''' is connected to main refrigerant first fraction upper outlet header 795.

The main refrigerant first fraction upper outlet header 795 provides at least one cooled first fraction main refrigerant stream 250'. A single cooled first fraction main refrigerant stream 250' is shown in FIG. 3. The at least one cooled first fraction main refrigerant stream 250' can be passed to at least one first fraction main refrigerant expansion device 255', where the at least one stream is expanded to provide at least one expanded first fraction main refrigerant stream 270'. The at least one expanded first fraction main refrigerant stream 270 can then be passed to the shell side 78 of the main heat exchanger 5 as at least one cooling main refrigerant stream. The at least one cooling main refrigerant stream provides main refrigerant to cool the fluids in the groups of the lower, intermediate and upper flow passages 40*a*', 40*b*', 40*a*'', 40*b*'', 40*a*''', 40*b*''', 240', 240'', 240''', 340', 340''.

Similarly, a second fraction 210*b* of the main refrigerant stream is auto-cooled by indirect heat exchange against main refrigerant in the shell side 78 of the exchanger by passing it through at least one main refrigerant lower second flow passage 340' and at least one main refrigerant intermediate flow passage 340''.

The second fraction 210*b* of a main refrigerant stream is passed to at least one second fraction main refrigerant part stream inlet header 335'. Each second fraction main refrigerant part stream inlet header 335' is connected to at least one main refrigerant lower second flow passage 340' or group of such flow passages. The other end of the at least one main refrigerant lower second flow passage 340' is connected to a main refrigerant second fraction lower outlet header 755*b*.

The main refrigerant second fraction lower outlet header 755*b* is connected to at least one main refrigerant second fraction lower stream 760*b*. The at least one main refrigerant second fraction lower stream 760*b* is passed to a main refrigerant second fraction intermediate inlet header 765*b*.

The main refrigerant second fraction intermediate inlet header 765*b* is connected to at least one main refrigerant intermediate second flow passage 340'' or group of such flow passages. The other end of the at least one main refrigerant intermediate second flow passage 340'' is connected to main refrigerant second fraction intermediate outlet header 347. The main refrigerant second fraction intermediate outlet header 347 provides at least one cooled second fraction main refrigerant stream 350'. A single cooled second fraction main refrigerant stream 350' is shown in FIG. 3.

The at least one cooled second fraction main refrigerant stream 350' can be passed to at least one second fraction main refrigerant expansion device 355' where the at least one stream is expanded to provide at least one expanded second fraction main refrigerant stream 370'. The at least one expanded second fraction main refrigerant stream 370' can then be passed to the shell side 78 of the main heat exchanger 5 as an at least one cooling main refrigerant stream. The at least one cooling main refrigerant stream provides main refrigerant to cool the fluids in the groups of lower and intermediate flow passages 40*a*', 40*b*', 40*a*'', 40*b*'', 240', 240'', 340', 340''.

In a preferred embodiment, the method disclosed herein can be utilised as part of a liquefaction process for a hydrocarbon feed stream. The hydrocarbon feed stream may be any suitable gas stream to be cooled and liquefied, but is usually a natural gas stream. Usually a natural gas stream is a hydrocarbon composition comprised substantially of methane. Preferably the hydrocarbon feed stream comprises at least 50 mol % methane, more preferably at least 80 mol % methane.

Hydrocarbon compositions such as natural gas may also contain non-hydrocarbons such as $H_2O$, $N_2$, $CO_2$, Hg, $H_2S$ and other sulphur compounds, and the like. If desired, the natural gas may be pre-treated before cooling and any liquefying. This pre-treatment may comprise reduction and/or removal of undesired components such as $CO_2$ and $H_2S$ or other steps such as early cooling, pre-pressurizing or the like. As these steps are well known to the person skilled in the art, their mechanisms are not further discussed here.

Thus, the term "hydrocarbon feed stream" may also include a composition prior to any treatment, such treatment including cleaning, dehydration and/or scrubbing, as well as any composition having been partly, substantially or wholly treated for the reduction and/or removal of at least one compound or substance, including but not limited to sulphur, sulphur compounds, carbon dioxide, water, Hg, and at least one C2+ hydrocarbon.

Depending on the source, natural gas may contain varying amounts of hydrocarbons heavier than methane such as in particular ethane, propane and butanes, and possibly lesser amounts of pentanes and aromatic hydrocarbons. The composition varies depending upon the type and location of the gas.

Conventionally, the hydrocarbons heavier than methane may be removed to various extents from the hydrocarbon feed stream prior to any significant cooling for several reasons. Components heavier than butanes, for example, have freezing temperatures high enough that may cause them to block parts of a methane liquefaction plant and hence these are essentially fully removed. C2-4 components are often extracted to meet a desired specification of the liquefied product. C2-4 hydrocarbons can be separated from, or their content reduced in a hydrocarbon feed stream by a demethanizer, which will provide an overhead hydrocarbon stream which is methane-rich and a bottoms methane-lean stream comprising the C2-4 hydrocarbons. The bottoms methane-lean stream can then be passed to further separators to provide Liquefied Petroleum Gas (LPG) and condensate streams.

After separation, the hydrocarbon stream which is methane-rich is cooled and liquefied. The hydrocarbon stream is passed against at least one refrigerant stream in at least one refrigerant circuit, such as a main refrigerant circuit. In a preferred embodiment, prior to cooling and liquefying in a main heat exchanger of a main refrigerant stage, the hydrocarbon stream can be pre-cooled against a pre-cooling refrigerant. The pre-cooling could be provided by a number of methods known in the art.

Such a refrigerant circuit may comprise at least one refrigerant compressor to compress an at least partly evaporated refrigerant stream to provide a compressed refrigerant stream. The compressed refrigerant stream may then be cooled in a cooler, typically an ambient cooler such as an air or water cooler, to provide the refrigerant stream as a first cooled refrigerant stream. The refrigerant compressors may be driven by at least one turbine or electric motor.

The cooling and liquefying of the hydrocarbon stream can be carried out in at least one stage. Initial cooling, also called pre-cooling or auxiliary cooling, can be carried out using a pre-cooling refrigerant, such as a single or mixed refrigerant, of a pre-cooling refrigerant circuit, in at least one pre-cooling heat exchanger, to provide a pre-cooled hydrocarbon stream. The pre-cooled hydrocarbon stream is preferably partially liquefied, such as at a temperature below 0° C.

Preferably, such pre-cooling heat exchangers could comprise a pre-cooling stage, with any subsequent cooling being carried out in at least one main heat exchanger to liquefy a fraction of the hydrocarbon stream in at least one main and/or sub-cooling cooling stage.

In this way, two or more cooling stages may be involved, each stage having at least one step, parts etc. For example, each cooling stage may comprise one to five heat exchangers. The or a fraction of a hydrocarbon stream and/or the refrigerant may not pass through all, and/or all the same, heat exchangers of a cooling stage.

In one embodiment, the hydrocarbon may be cooled and liquefied in a method comprising two or three cooling stages. A pre-cooling stage is preferably intended to reduce the temperature of a hydrocarbon feed stream to below 0° C., usually in the range −20° C. to −70° C.

Heat exchangers for use as the two or more pre-cooling heat exchangers are well known in the art. The pre-cooling heat exchangers may be selected from the group comprising coil wound heat exchangers, plate-fin heat exchangers and shell and tube heat exchangers.

A main cooling stage according to the method and apparatus described herein is then carried out. The main cooling stage is separate from the pre-cooling stage. That is, the main cooling stage comprises at least one separate main heat exchanger. The main cooling stage is preferably intended to reduce the temperature of a hydrocarbon stream, usually at least a fraction of a hydrocarbon stream cooled by a pre-cooling stage, to below −100° C.

At least one of any of the heat exchangers is a heat exchanger as described herein, such as a spool wound heat exchanger according to the embodiments of FIG. 1, 2 or 3 or a shell and tube heat exchanger. Optionally, the heat exchanger could comprise at least one cooling section within its shell, and each cooling section could be considered as a cooling stage or as a separate 'heat exchanger' to the other cooling locations.

In another embodiment, one or both of the pre-cooling refrigerant stream and any main refrigerant stream can be passed through at least one heat exchanger, preferably two or more of the pre-cooling and main heat exchangers described hereinabove, to provide cooled mixed refrigerant streams.

If the refrigerant is a mixed refrigerant in a mixed refrigerant circuit, such as the pre-cooling refrigerant circuit or any main refrigerant circuit, the mixed refrigerant may be formed from a mixture of two or more components selected from the group consisting of: nitrogen, methane, ethane, ethylene, propane, propylene, butanes, pentanes. At least one other refrigerant may be used, in separate or overlapping refrigerant circuits or other refrigeration circuits.

Any pre-cooling refrigerant circuit may comprise a mixed pre-cooling refrigerant. The main refrigerant circuit preferably comprises a mixed main cooling refrigerant. A mixed refrigerant or a mixed refrigerant stream as referred to herein comprises at least 5 mol % of two different components. More preferably, the mixed refrigerant comprises two or more of the group comprising: nitrogen, methane, ethane, ethylene, propane, propylene, butanes and pentanes.

A common composition for a pre-cooling mixed refrigerant can be:

| | |
|---|---|
| Methane (C1) | 0-20 mol % |
| Ethane (C2) | 5-80 mol % |
| Propane (C3) | 5-80 mol % |
| Butanes (C4) | 0-15 mol % |

The total composition comprises 100 mol %.

A common composition for a main cooling mixed refrigerant can be:

| | |
|---|---|
| Nitrogen | 0-25 mol % |
| Methane (C1) | 20-70 mol % |
| Ethane (C2) | 30-70 mol % |
| Propane (C3) | 0-30 mol % |
| Butanes (C4) | 0-15 mol % |

The total composition comprises 100 mol %.

In another embodiment, hydrocarbon stream cooled and liquefied in the main heat exchanger may have been pre-cooled. The hydrocarbon stream, such as a pre-cooled natural gas stream, is then further cooled in the main heat exchanger to provide an at least partially, preferably fully, liquefied hydrocarbon stream, such as an LNG stream.

Preferably, the liquefied hydrocarbon stream provided by the method and apparatus described herein is stored in at least one storage tank, usually before being transported to another location by a carrier vessel.

Figure 4:
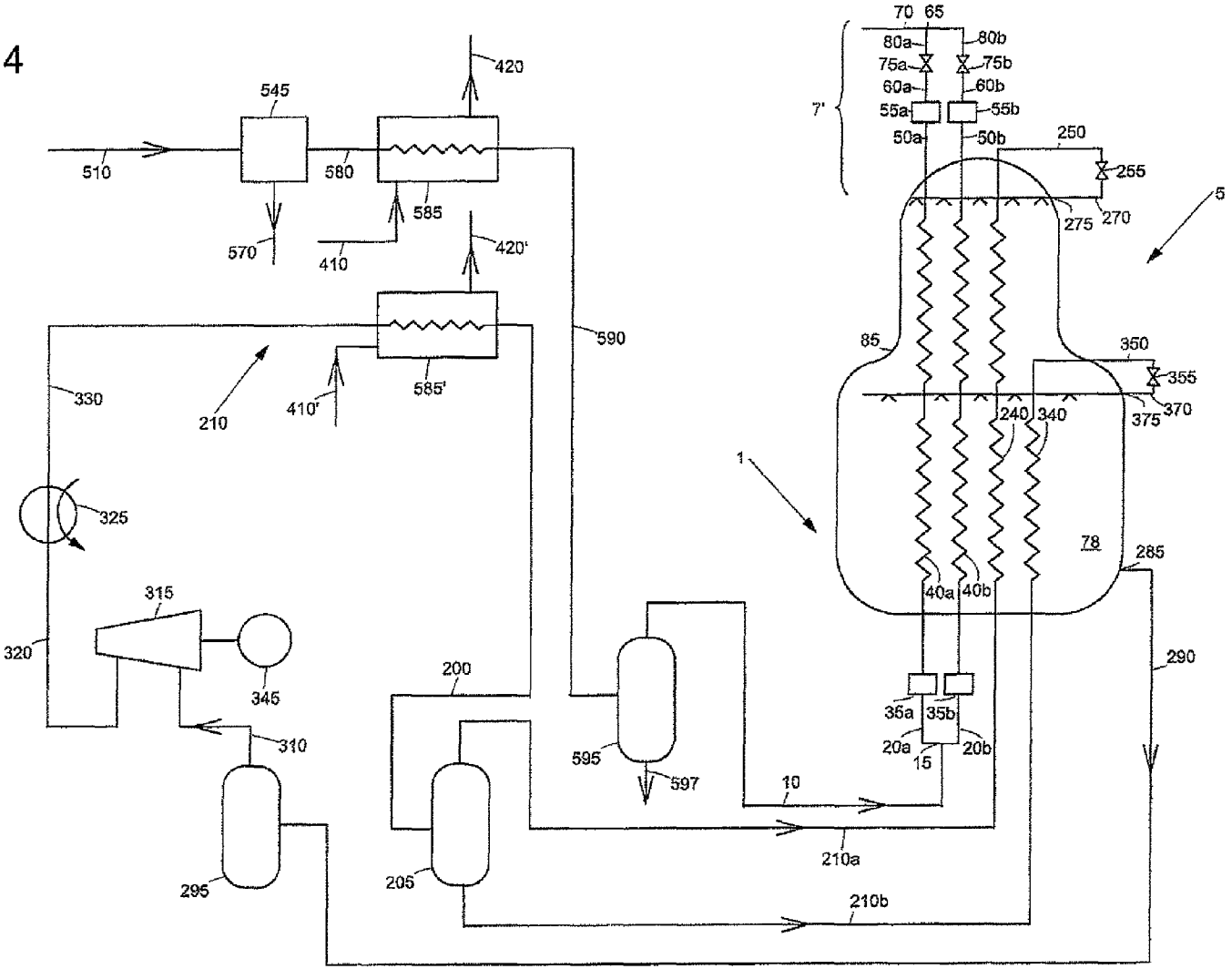
FIG. 4 is a diagrammatic scheme of a method for liquefying a hydrocarbon stream utilising the apparatus of the invention according to another embodiment.

FIG. 4 is a diagrammatic scheme of an apparatus 1 for cooling and liquefying a hydrocarbon stream 10. A number of methods of treating and liquefying hydrocarbon streams are known in the art. The embodiment of FIG. 4 is one such exemplary method.

A hydrocarbon feed stream 510 is provided, such as a stream derived from natural gas. The hydrocarbon feed stream 510 is preferably in a form suitable for liquefying, such that it may have been pre-treated to reduce and/or remove undesired components such as $CO_2$ and $H_2S$.

The hydrocarbon feed stream 510 is preferably a pressurised stream which may be passed to an optional extraction unit 545 with the purpose of extracting components from the hydrocarbon feed stream 510, to produce a prepared stream 580 that is ready to be cooled and liquefied into a liquefied product stream 70 that has a composition in accordance within boundaries of a pre-determined specification. The prepared stream 580 may for instance be provided in the form of a compressed methane enriched stream 580. There are many such extraction units available in the art, as well known to the person skilled in the art. As an example, it may comprise a scrub column or demethanizer and an optional recompressor.

The extracted components may be discharged from the extraction unit 545 in the form of extraction product stream 570, which is usually a liquid stream. If the extraction unit 545 is based on a demethanizer, the extraction product stream 570 may be a methane depleted stream 570, typically in the form an NGL stream. The extraction product stream 570 may optionally be passed to at least one further fractionation device (not shown), such as a deethanizer, a depropanizer and/or a debutanizer for natural gas liquids extraction.

The resulting prepared stream 580, which for the present example will be assumed to be a compressed methane enriched stream, may be passed to at least one pre-cooling heat exchanger 585, in which it is cooled against a pre-cooling refrigerant to provide a pre-cooled prepared stream 590, which in the present example is assumed to be a pre-cooled methane enriched hydrocarbon stream. The pre-cooling refrigerant may be fed to the pre-cooling heat exchanger as an incoming cooled pre-cooling refrigerant stream 410 and withdrawn from the pre-cooling heat exchanger as an outgoing warmed pre-cooling refrigerant stream 420. Preferably the incoming cooled pre-cooling refrigerant stream 410 is essentially in liquid form, while the outgoing warmed pre-cooling refrigerant stream 420 is preferably essentially in vapour form. The pre-cooling refrigerant may be a single component pre-cooling refrigerant, often consisting essentially of propane, or a mixed pre-cooling refrigerant, such as a mixed pre-cooling refrigerant comprising propane. If a plurality of pre-cooling heat exchangers 585, the pre-cooling refrigerant can be provided at a different pressure in each pre-cooling heat exchanger 585.

The pre-cooled methane enriched hydrocarbon stream 590 may be passed directly to the main heat exchanger 5 in the form of hydrocarbon stream 10. However, in the embodiment of FIG. 4 it first passed to an optional main heat exchanger separator 595, such as a gas liquid separator, for instance in order to produce a liquid reflux stream 597 for the benefit of the extraction unit 545 (not shown). In such as case, the hydrocarbon stream 10 is provided from the main heat exchanger separator 595 in the form of an overhead vapour stream.

Figure 5:
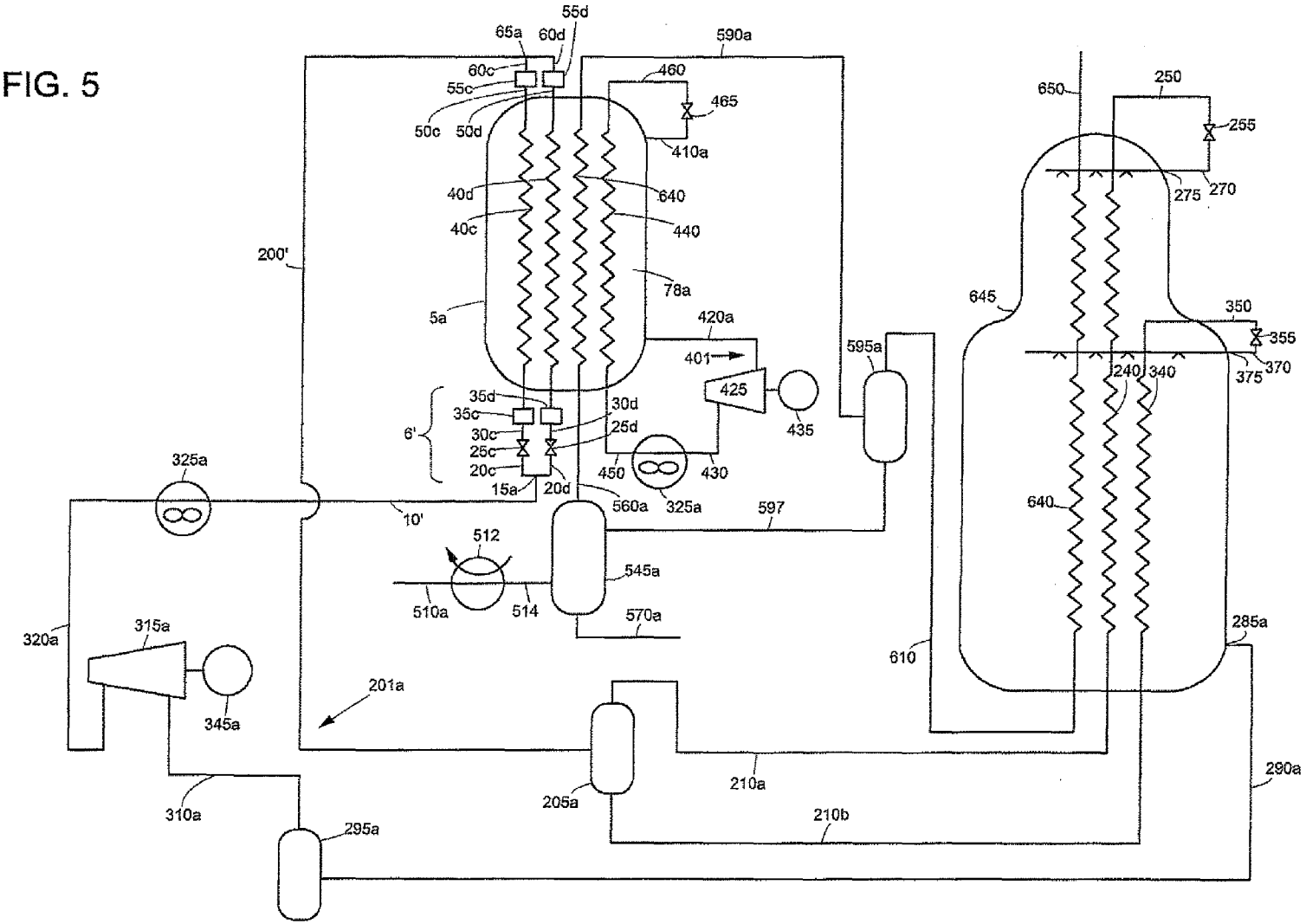
FIG. 5 is a diagrammatic scheme of a method for liquefying a hydrocarbon refrigerant stream utilising the apparatus of the invention according to a further embodiment.

For simplicity, the remainder of the pre-cooling refrigerant circuit is not shown. The configuration of such a pre-cooling refrigerant circuit is known to the skilled person. One example of a suitable pre-cooling refrigerant circuit is shown in FIG. 5.

The embodiment of FIG. 4 shows the hydrocarbon stream 10 being passed to a heat exchanger 5, which is a main heat exchanger, for cooling liquefying. The main heat exchanger 5 has an identical construction of main refrigerant first and second flow passages 240, 340 to the embodiment of FIG. 1.

The embodiment of FIG. 4 shows an alternative location of the selective blocking means. The primary outlet header 7' shows a combiner 65 that combines the liquefied fluid part streams 60*a*,60*b* from each primary part stream outlet header 55*a*,55*b* to provide the combined liquefied fluid stream 70. However, the means for selectively blocking at least one of the primary groups of primary flow passages 40*a*,40*b* is now located in the primary outlet header 7'. A fluid part stream outlet control valve 75*a*,75*b* is provided between the primary part stream outlet headers 55*a*,55*b* and the liquefied fluid stream combining device 65.

Thus, in this embodiment, the means for selectively blocking 75*a*, 75*b* at least one of the two or more hydrocarbon flow passages 40*a*, 40*b* is provided downstream of the main heat exchanger 5, rather than upstream as shown in FIGS. 1 and 2. It will be understood that the downstream location of the selective blocking means may likewise be applied to the secondary outlet header means for the secondary group 240 of auto-cooling flow passages. It will also be understood that the configuration of FIG. 1 or FIG. 2 may be employed in the scheme of FIG. 4 if desired instead of the alternative location of the selective blocking means.

In the embodiment of FIG. 4, the hydrocarbon stream 10 is passed to a means for splitting 15 the hydrocarbon stream 10 between two or more hydrocarbon stream flow passages 40*a*, 40*b*, such as a hydrocarbon stream splitting device. The means for splitting 15 the hydrocarbon stream 10 provides two or more hydrocarbon part streams 20*a*, 20*b*. The two or more hydrocarbon part streams 20*a*, 20*b* can be connected to two or more part stream inlet headers 35*a*, 35*b*. Each hydrocarbon part stream inlet header 35*a*, 35*b* is connected to at least one of the hydrocarbon flow passage 40*a*, 40*b*.

The two or more hydrocarbon flow passages 40*a*, 40*b* exit the main heat exchanger 5 at two or more hydrocarbon flow passage outlets 45*a*, 45*b*. Each outlet 45*a*, 45*b* produces a liquefied hydrocarbon stream 50*a*, 50*b*. The two or more hydrocarbon flow passages 40*a*, 40*b* are connected to two or more part stream outlet headers 55*a*, 55*b*. Each part stream outlet header 55*a*, 55*b* provides a liquefied hydrocarbon part stream 60*a*, 60*b* to a hydrocarbon part stream outlet control valve 75*a*, 75*b*. The hydrocarbon part stream outlet control valve 75*a*, 75*b* is a means for selectively blocking at least one of the two or more hydrocarbon flow passages 40*a*, 40*b*.

Each hydrocarbon stream outlet control valve 75*a*, 75*b* provides a controlled liquefied hydrocarbon part stream 80*a*, 80*b*. The two or more controlled liquefied hydrocarbon part streams 80*a*, 80*b* can be passed to a controlled liquefied hydrocarbon part stream combining device 65 to provide the combined liquefied hydrocarbon stream 70.

It will be apparent that closing one of the hydrocarbon part stream outlet control valves 75*a*, 75*b* will selectively block the respective hydrocarbon flow passage 40*a*, 40*b* or group of such flow passages. In this way, the mass flow of the hydrocarbon stream 10 to the main heat exchanger 5 can be reduced while avoiding unstable cooling behaviour in the hydrocarbon flow passages 40*a*, 40*b*.

FIG. 4 additionally shows a main refrigerant cooling circuit 201. In this embodiment, the main refrigerant is a mixed main refrigerant, such as that discussed above.

A main refrigerant stream 200 is passed to a main refrigerant separation device 205, such as a gas/liquid separator. The main refrigerant separation device provides the first and second fraction main refrigerant streams 210*a*, 210*b* which are passed to the main heat exchanger 5. The first fraction main refrigerant stream 210*a* is preferably a vapour stream drawn overhead from the main refrigerant separation device 205. The second fraction main refrigerant stream 210*b* is preferably a liquid stream drawn from the bottom of the main refrigerant separation device 205.

The first and second fraction main refrigerant streams 210*a*, 210*b* are auto-cooled in the main heat exchanger 5, expanded and passed to the shell side 78 of the exchanger as discussed for the embodiment of FIG. 1. The main refrigerant is indirectly heat exchanged with the fluids in the groups of flow passages 40*a*, 40*b*, 240, 340 to cool the fluids and warm the main refrigerant. The warm refrigerant is withdrawn from at least one main refrigerant outlet 285 at or near the bottom of the main heat exchanger 5, as warmed main refrigerant stream 290.

The warmed main refrigerant stream 290 is passed to a main refrigerant compressor knock-out drum 295. The main refrigerant compressor knock-out drum 295 provides a main refrigerant compressor feed stream 310. The main refrigerant compressor feed stream 310 can be substantially gaseous.

The main refrigerant compressor feed stream 310 is passed to a main refrigerant compressor 315 in which it is compressed to provide a compressed main refrigerant stream 320. The main refrigerant compressor 315 is mechanically driven by a main refrigerant compressor driver 345 such as a gas or stream turbine, or an electric motor.

The compressed main refrigerant stream 320 is then cooled in at least one main refrigerant cooling device 325, such as an air or water cooler, to provide a first cooled main refrigerant stream 330. The first cooled main refrigerant stream 330 can then be passed to at least one pre-cooling heat exchanger 585' for further cooling against a pre-cooling refrigerant to provide the main refrigerant stream 200. As shown in FIG. 4, the first cooled main refrigerant stream 330 may be cooled in in a separate pre-cooling heat exchanger from the compressed methane enriched stream 580. The incoming and outgoing refrigerant streams 410',420' may nevertheless be part of the same pre-cooling refrigerant cycle.

Alternatively, the first cooled main refrigerant stream 330 may cooled in the same pre-cooling heat exchanger as the compressed methane enriched stream 580, for instance when there are two separate tube bundles available in the pre-cooling heat exchanger.

As the first fraction main refrigerant stream 210*a* is normally condensed under influence of the auto-cooling, the selective blocking arrangement may also be applied to the main refrigerant first flow passages 240 such as exemplified in e.g. FIG. 2. Clearly, also in this case the selective blocking may be located downstream of the main heat exchanger in a secondary outlet header, similar to the primary outlet header.

As an example where the resulting liquefied hydrocarbon stream not used as a product stream as such, FIG. 5 shows an embodiment in which the hydrocarbon steam 10' is used as a main cooling mixed refrigerant stream to provide cooling duty to a main heat exchanger. In this case, the apparatus of the invention is provided in the form of a pre-cooling heat exchanger 5*a* wherein the main cooling mixed refrigerant stream is partially liquefied.

Although only a single pre-cooling heat exchanger 5*a* is shown in FIG. 5, more than one pre-cooling heat exchanger can be provided with two or more hydrocarbon flow passages which can be selectively blocked. For instance, two pre-cooling heat exchangers may be provided, for example in series or in parallel. The pre-cooling heat exchangers may operate at the same or difference pressures of pre-cooling refrigerant in the shell side 78*a*.

A hydrocarbon feed stream 510*a* is provided, such as a stream derived from natural gas. The hydrocarbon feed stream 510*a* is preferably in a form suitable for liquefying, such that it may have been pre-treated to reduce and/or remove undesired components such as $CO_2$ and $H_2S$.

The hydrocarbon feed stream 510*a* is preferably a pressurised stream. The hydrocarbon feed stream 510*a* can be cooled in a hydrocarbon feed heat exchanger 512 to provide a cooled hydrocarbon feed stream 514.

The cooled hydrocarbon feed stream 514 may be passed to an optional hydrocarbon feed fractionation device 545*a*, such as a scrub column or demethanizer, to provide a methane enriched overhead stream 560*a* and a methane depleted bottoms stream 570*a*. The methane depleted bottoms stream 570*a* can be passed to at least one further fractionation device (not shown), such as a deethanizer, a depropanizer and/or a debutanizer for natural gas liquids extraction.

The methane enriched overhead stream 560*a* from the hydrocarbon feed fractionation device 545*a* can be passed to at least one pre-cooling heat exchanger 585*a*. The methane enriched overhead stream 560*a* can be passed through at least one methane enriched stream flow passage 640 in the pre-cooling heat exchanger 5*a* for cooling against a pre-cooling refrigerant in the shell side 78*a* of the heat exchanger to provide a pre-cooled methane enriched hydrocarbon stream 590*a*.

The pre-cooling refrigerant may be a mixed pre-cooling refrigerant, such as a mixed pre-cooling refrigerant comprising propane. If a plurality of pre-cooling heat exchangers 585*a* are used with a mixed pre-cooling refrigerant, the mixed pre-cooling refrigerant can be provided at a different pressure in the shell side 78*a* of different pre-cooling heat exchangers 585*a*.

The pre-cooling refrigerant is provided in a pre-cooling refrigerant circuit 401. A pre-cooling refrigerant compressor feed stream 420*a* as an outgoing warmed pre-cooling refrigerant stream from pre-cooling heat exchanger 5*a* is passed to a pre-cooling refrigerant compressor 425. The pre-cooling refrigerant compressor compresses the pre-cooling refrigerant compressor feed stream 420*a* to provide a compressed pre-cooling refrigerant stream 430. The pre-cooling refrigerant compressor 425 can be mechanically driven by a pre-cooling refrigerant compressor driver 435, such as a gas or stream turbine or an electric motor.

The compressed pre-cooling refrigerant stream 430 can then be cooled in at least one pre-cooling refrigerant cooling device 325*a*, such as an air or water cooler, to provide a first cooled pre-cooling refrigerant stream 450. The first cooled pre-cooling refrigerant stream 450 can then be passed to the at least one pre-cooling heat exchanger 5*a*. The first cooled pre-cooling refrigerant stream 450 can be passed through at least one pre-cooling refrigerant flow passage 440 in the pre-cooling heat exchanger 5*a*. The pre-cooling refrigerant in the pre-cooling refrigerant flow passage 440 is auto cooled against pre-cooling refrigerant in the shell side 78*a* of the heat exchanger to provide a second cooled pre-cooling refrigerant stream 460.

The second cooled pre-cooling refrigerant stream 460 can be passed to at least one pre-cooling refrigerant expansion device 465, such as a Joule-Thomson valve or expander, where the stream is expanded to provide at least one expanded pre-cooling refrigerant stream 410*a* as an incoming cooled pre-cooling refrigerant stream. The at least one expanded pre-cooling refrigerant stream 410*a* can then be passed to the shell side 78*a* of the pre-cooling heat exchanger 5*a* to cool the contents of flow passages 40*c*, 40*d*, 440, 640.

The at least one pre-cooling heat exchanger 585*a* provides the pre-cooled methane enriched hydrocarbon stream 590*a*. The pre-cooled methane enriched hydrocarbon stream 590*a* can be passed to a main heat exchanger separator 595*a*, such as a gas/liquid separator. The main heat exchanger separator 595*a* can provide a methane enriched main heat exchanger feed stream 610 as an overhead vapour stream and a feed fractionation reflux stream 597 as a bottoms liquid stream.

The feed fractionation reflux stream 597 can be passed to the hydrocarbon feed fractionation device 545*a*. It is preferred that the feed fractionation reflux stream 597 is passed to the hydrocarbon feed fractionation device 545*a* at a point gravitationally higher than the cooled hydrocarbon feed stream 514 to provide improved separation.

The embodiment of FIG. 5 shows the methane enriched main heat exchanger feed stream 610 being passed to a conventional main heat exchanger 645. The methane enriched main heat exchanger feed stream 610 can be passed through at least one methane enriched stream flow passage 640, in which it is indirectly cooled and liquefied against a main cooling refrigerant, such as a mixed main cooling refrigerant.

The main heat exchanger 645 provides a liquefied, possibly a partially liquefied but preferably a fully liquefied, methane enriched stream 650. When the hydrocarbon feed stream 510*a* is derived from natural gas, the liquefied methane enriched stream 650 can be LNG.

FIG. 5 additionally shows a main refrigerant cooling circuit 201*a*. In this embodiment, the main refrigerant is a mixed main cooling refrigerant comprising at least one hydrocarbon, such as that discussed above.

A main refrigerant compressor feed stream 310*a* is passed to a main refrigerant compressor 315*a* in which it is compressed to provide a compressed main refrigerant stream 320*a*. The main refrigerant compressor 315*a* can be mechanically driven by a main refrigerant compressor driver 345*a*, such as a gas or stream turbine or an electric motor.

The compressed main refrigerant stream 320*a* can then be cooled in at least one main refrigerant cooling device 325*a*, such as an air or water cooler, to provide a first cooled main refrigerant stream as a hydrocarbon stream 10'. The first cooled main refrigerant stream 10' (hydrocarbon stream) can then be passed to at least one pre-cooling heat exchanger 5*a* for further cooling against a pre-cooling refrigerant.

The first cooled main refrigerant stream 10' (hydrocarbon stream) may be cooled in the same or a different pre-cooling heat exchanger as the methane enriched overhead stream 560*a*. In the embodiment of FIG. 5, the first cooled main refrigerant stream 10' (hydrocarbon stream) is cooled in the same pre-cooling heat exchanger 5*a* as the methane enriched overhead stream 560*a*.

The pre-cooling heat exchanger 5*a* of FIG. 5 provides two or more first cooled main refrigerant flow passages 40*c*, 40*d* as the two or more primary groups of primary flow passages, together with means for selectively blocking 25*c*, 25*d* at least one of the two of more main refrigerant flow passages 40*c*, 40*d*, such that the mass flow of the first cooled main refrigerant stream 10' through the pre-cooling heat exchanger 5*a* can be reduced, without incurring unstable cooling behaviour. This design is advantageous when the first cooled main refrigerant stream 10' is a substantially vapour stream which is at least partially liquefied in the pre-cooling heat exchanger 5*a*.

The first cooled main refrigerant stream 10' can be passed to primary inlet header 6', which may comprise a means for splitting 15*a* the fluid stream in the form of the first cooled main refrigerant stream 10' between the two or more primary groups of primary flow passages 40*c*, 40*d*. The means for splitting 15*a* may comprise a first cooled main refrigerant splitting device. The first cooled main refrigerant splitting device 15*a* can provide two or more first cooled main refrigerant part streams 20*c*, 20*d* as hydrocarbon part streams.

Each of the two or more first cooled main refrigerant part streams 20*c*, 20*d* (fluid part streams) may be passed to a first cooled main refrigerant part stream inlet control valve 25*c*, 25*d* (primary part stream inlet control valve). Each first cooled main refrigerant part stream inlet control valve 25*a*, 25*b* (primary part stream inlet control valve) provides a controlled first cooled main refrigerant part stream 30*c*, 30*d*.

Two or more first cooled main refrigerant part stream inlet headers 35*c*, 35*d* are provided as primary part stream inlet headers to receive the controlled first cooled main refrigerant part streams 30*c*, 30*d*. Each first cooled main refrigerant part stream inlet header 35*c*, 35*d* is connected to a first cooled main refrigerant flow passage 40*c*, 40*d*, or group of such flow passages, to be selectively blocked together. Thus, by closing a first cooled main refrigerant part stream inlet control valve 25*c*, 25*d*, a first cooled main refrigerant part stream 20*c*, 20*d* is prevented from reaching the respective first cooled main refrigerant part stream inlet header 35*c*, 35*d* and therefore the respective first cooled main refrigerant flow passage 40*c*, 40*d*. In this way, the mass flow of the main refrigerant through the pre-cooling heat exchanger 5*a* can be reduced while mitigating against unstable cooling behaviour.

The first cooled main refrigerant part streams can be indirectly cooled against pre-cooling refrigerant in the shell side 78*a* of the exchanger in the first cooled main refrigerant flow passages 40*c*, 40*d* to provide two or more second partially liquefied main refrigerant part streams 50*c*, 50*d* as liquefied hydrocarbon streams.

The two or more first cooled main refrigerant flow passages 40*c*, 40*d* can be connected to a primary outlet header comprising at least one second liquefied main refrigerant stream outlet header 55*c*, 55*d*. The embodiment of FIG. 5 shows a second liquefied main refrigerant stream outlet header 55*c*, 55*d* for each first cooled main refrigerant flow passage 40*c*, 40*d*, or group of passages, which can be selectively blocked. Each second liquefied main refrigerant stream outlet header 55*c*, 55*d* can provide a liquefied fluid, in the form of pre-cooled main refrigerant part stream 60*c*, 60*d*.

The pre-cooled main refrigerant part streams 60*c*, 60*d* can be combined in a pre-cooled main refrigerant combining device 65*a* to provide a pre-cooled main refrigerant stream 200' as a main refrigerant stream.

The pre-cooled main refrigerant stream 200' can be passed to a main refrigerant separation device 205*a*, such as a gas/liquid separator. The main refrigerant separation device 205*a* provides the first and second fraction main refrigerant streams 210*a*, 210*b* which are passed to the main heat exchanger 645. The first fraction main refrigerant stream 210*a* is preferably a vapour stream drawn overhead from the main refrigerant separation device 205*a*. The second fraction main refrigerant stream 210*b* is preferably a liquid stream drawn from the bottom of the main refrigerant separation device 205*a*.

The first and second fraction main refrigerant streams 210*a*, 210*b* are auto-cooled in the main heat exchanger, expanded and passed to the shell side 78 of the exchanger as discussed for the embodiment of FIG. 1. The main refrigerant is indirectly heat exchanged with the fluids in the groups of flow passages 240, 340, 640 to cool the fluids and warm the main refrigerant. The warm refrigerant is withdrawn from at least one main refrigerant outlet 285*a* at or near the bottom of the main heat exchanger 645, as warmed main refrigerant stream 290*a*.

The warmed main refrigerant stream 290*a* can be passed to a main refrigerant compressor knock-out drum 295*a*. The main refrigerant compressor knock-out drum 295*a* provides the main refrigerant compressor feed stream 310*a*, which can be a substantially vapour stream.

The person skilled in the art will understand that the present invention can be carried out in many various ways without departing from the scope of the appended claims. For instance, the process scheme according to FIG. 4 can be utilised with an apparatus as disclosed in the embodiment of FIG. 2, allowing the first fraction main refrigerant flow channels to be selectively blocked as well as the hydrocarbon flow channels, during turn down operation.

Furthermore, the process scheme according to FIG. 5 could be used with a main heat exchanger 5 according to the embodiments of FIG. 1 or 2 or 4, such that enhanced thermal stability may also be provided to one or both of the hydrocarbon stream 10 and/or the first fraction 210*a* of the main refrigerant stream.

The Figures provided herein show the various inlet and outlet headers of the hydrocarbon part streams and refrigerant streams being situated outside the shell of the heat exchanger. However, it will be apparent to the skilled person that in an alternative embodiment, one or both of the inlet and outlet headers can be placed inside the heat exchanger, within its walls. However, it is preferred that at least the means for selectively blocking is located outside the walls of the heat exchanger to facilitate access and control over these means.

The description above describes the means for selectively blocking at least one of the two or more primary groups of primary flow passages in a conceptual level. In practice, these means may be carried out in a more sophisticated manner in accordance with the normal design practises adopted by the person skilled in the art. For instance, the means for selectively blocking may be arranged to avoid backflow from an open (not blocked) group of flow passages via a shared header into a blocked group of flow passages (not shown). This may for instance be achieved by providing a concertedly operated valve on each end of the groups of flow passages that need to be selectively blocked, and not exclusively on the inlet end or the outlet end of the group of flow passages.

The methods and apparatuses disclosed herein are specifically suitable for cooling and liquefying a fluid comprising natural gas in the form of or derived from coal bed methane, which is expected to suffer from relatively large variations in flow rate.

The person skilled in the art will understand that the present invention can be carried out in many various ways without departing from the scope of the appended claims.

We claim:

1. An apparatus for cooling and liquefying a fluid stream to provide a liquefied fluid stream, said apparatus comprising at least:

a heat exchanger having a wall defining and encompassing an internal volume comprising a shell side, and a plurality of flow passages extending through the shell side of the heat exchanger, said plurality of flow passages comprising two or more primary groups of one or more primary flow passages, wherein the primary flow passages are arranged to transport the fluid stream from an inlet at or near the bottom of the heat exchanger to an outlet at a point gravitationally higher within the heat exchanger, each said primary group for carrying a part of the fluid stream through the heat exchanger and to indirectly cool said part against a refrigerant in the shell side of the heat exchanger, wherein the part of the fluid stream moves upward through the heat exchanger wile said part of said fluid stream is at least being partly condensed to provide a liquefied fluid stream;

a primary inlet header connecting the two or more primary groups of primary flow passages to a source of the fluid, and arranged to split the fluid stream between the two or more primary groups of primary flow passages;

means for selectively blocking at least one of the two or more primary groups of primary flow passages in response to a flow rate of the fluid stream, whilst allowing the fluid stream to flow through the remaining unblocked primary groups of primary flow passages;

wherein the plurality of flow passages further comprises two or more secondary groups of one or more auto-cooling flow passages, said apparatus further comprising:

a secondary inlet header connecting the two or more secondary groups of auto-cooling flow passages to a source of the refrigerant, and arranged to split the refrigerant stream between the two or more secondary groups of auto-cooling flow passages;

secondary means for selectively blocking at least one of the two or more secondary groups of auto-cooling flow passages whilst allowing the refrigerant stream to flow through the remaining unblocked secondary groups of auto-cooling flow passages; and at least one expansion device downstream of the secondary groups of auto-cooling flow passages, and upstream of a refrigerant inlet device into the shell of the heat exchanger and connected to the refrigerant inlet device.

2. The apparatus according to claim 1, wherein the primary inlet header comprises:

two or more primary part stream inlet headers, each uniquely connected to one of the primary groups of primary flow passages;

a primary header stream splitting device to separate the fluid stream into two or more fluid part streams each in a fluid part stream conduit;

whereby the means for selectively blocking at least one of the primary groups of primary flow passages whilst allowing flow to the remaining unblocked primary groups of primary flow passages comprises a primary part stream inlet control valve in at least one of the fluid part stream conduits.

3. The apparatus according to claim 1, wherein the heat exchanger is selected from the group consisting of a spool wound heat exchanger and a shell and tube heat exchanger, wherein the two or more primary groups of one or more primary flow passages are laid out intertwined with each other.

4. The apparatus according to claim 1, further comprising: a primary outlet header connected to two or more primary groups of primary flow passages to combine the liquefied fluid streams flowing out of the two or more primary groups of primary flow passages.

5. The apparatus according to claim 4, wherein the primary outlet header comprises two or more primary part stream outlet headers, each providing a liquefied fluid part stream, wherein each of the primary part stream outlet headers is uniquely connected to one primary group of primary flow passages, said apparatus further comprising: a liquefied fluid stream combining device downstream of the primary part stream outlet headers to combine the liquefied fluid part streams from each primary part stream outlet header to provide a combined liquefied fluid stream.

6. The apparatus according to claim 5, wherein the means for selectively blocking at least one of the primary groups of primary flow passages whilst allowing flow to the remaining unblocked primary groups of primary flow passages comprises: a fluid part stream outlet control valve between at least one of the primary part stream outlet headers and the liquefied fluid stream combining device.

7. The apparatus according to claim 1, wherein said primary group of primary flow passages comprises a heat exchange surface arranged to be in heat exchanging interaction with the refrigerant to indirectly cool said part of the fluid stream against the refrigerant in the shell side of the heat exchanger, wherein the part of the fluid stream is arranged to move along the heat exchange surface in an upward direction.

8. The apparatus according to claim 1, wherein the means for selectively blocking at least one of the two or more primary groups of primary flow passages whilst allowing the fluid stream to flow through the remaining unblocked primary groups of primary flow passages is located external to the wall of the heat exchanger relative to the shell side.

9. A method of cooling and liquefying a fluid stream to provide a liquefied fluid stream, comprising at least the steps of:

passing a fluid stream at a flow rate, and a refrigerant, to an apparatus comprising at least a heat exchanger having a wall defining and encompassing an internal volume comprising a shell side, and a plurality of flow passages extending through the shell side of the heat exchanger, said plurality of flow passages comprising two or more primary groups of one or more primary flow passages, each said primary group for carrying a part of the fluid stream through the heat exchanger and to indirectly cool said part against a refrigerant in the shell side of the heat exchanger to provide a liquefied fluid stream, wherein the part of the fluid stream moves upward through the heat exchanger while said part of said fluid stream is at least being partly condensed by said indirect cooling, and a primary inlet header connecting the two or more primary groups of primary flow passages to a source of the fluid, and arranged to split the fluid stream between the two or more primary groups of primary flow passages;

allowing the fluid stream into the primary inlet header;

allowing the refrigerant stream into a secondary inlet header connecting two or more secondary groups of the one or more auto-cooling flow passages to a source of the refrigerant, and arranged to split the refrigerant stream between the two or more secondary groups of auto-cooling flow passages;

allowing the refrigerant stream into the secondary inlet header;

expanding the refrigerant stream downstream of the secondary groups of auto-cooling flow passages, and upstream of a refrigerant inlet device into the shell of the heat exchanger and feeding the refrigerant stream to the refrigerant inlet device; and selectively blocking at least one of the two or more primary groups of primary flow passages in response to a flow rate of the fluid stream, whilst allowing the fluid stream to flow through the remaining unblocked primary groups of primary flow passages to provide a liquefied fluid stream;

selectively blocking at least one of the two or more secondary groups of auto-cooling flow passages whilst allowing the refrigerant stream to flow through the remaining unblocked secondary groups of auto-cooling flow passages.

10. The method according to claim 9, further comprising exporting at least part of the liquefied fluid stream from the method and apparatus.

11. The method according to claim 9, wherein the fluid stream is a hydrocarbon stream.

12. The method according to claim 11, wherein the hydrocarbon stream is derived from natural gas.

13. The method according to claim 9, wherein the fluid stream is derived from natural gas.

14. A method of cooling and liquefying a fluid stream to provide a liquefied fluid stream, comprising at least the steps of:

passing a fluid stream and a refrigerant through an apparatus thereby providing a liquefied fluid stream, wherein the apparatus comprises at least:

a heat exchanger having a wall defining and encompassing an internal volume comprising a shell side, and a plurality of flow passages extending through the shell side of the heat exchanger, said plurality of flow passages comprising two or more primary groups of one or more primary flow passages, wherein the primary flow passages are arranged to transport the fluid stream from an inlet at or near the bottom of the heat exchanger to an outlet at a point gravitationally higher within the heat exchanger, each said primary group for carrying a part of the fluid stream through the heat exchanger and to indirectly cool said part against a refrigerant in the shell side of the heat exchanger, wherein the part of the fluid stream moves upward through the heat exchanger while said part of said fluid stream is at least being partly condensed to provide a liquefied fluid stream;

a primary inlet header connecting the two or more primary groups of primary flow passages to a source of the fluid, and arranged to split the fluid stream between the two or more primary groups of primary flow passages;

means for selectively blocking at least one of the two or more primary groups of primary flow passages in response to a flow rate of the fluid stream, whilst allowing the fluid stream to flow through the remaining unblocked primary groups of primary flow passages;

wherein the plurality of flow passages further comprises two or more secondary groups of one or more auto-cooling flow passages, said apparatus further comprising:

a secondary inlet header connecting the two or more secondary groups of auto-cooling flow passages to a source of the refrigerant, and arranged to split the refrigerant stream between the two or more secondary groups of auto-cooling flow passages;

secondary means for selectively blocking at least one of the two or more secondary groups of auto-cooling flow passages whilst allowing the refrigerant stream to flow through the remaining unblocked secondary groups of auto-cooling flow passages; and at least one expansion device downstream of the secondary groups of auto-cooling flow passages, and upstream of a refrigerant inlet device into the shell of the heat exchanger and connected to the refrigerant inlet device.

15. The method of claim 14, wherein said passing of said fluid stream through the apparatus comprises:

allowing the fluid stream into the primary inlet header and selectively blocking at least one of the two or more primary groups of primary flow passages in response to the flow rate of the fluid stream, whilst allowing the fluid stream to flow through the remaining unblocked primary groups of primary flow passages.

16. The method according to claim 14, wherein the fluid stream is derived from natural gas.

* * * * *